US005315726A

United States Patent [19]

Borenstein

[11] Patent Number: 5,315,726

[45] Date of Patent: May 31, 1994

[54] MULTIPURPOSE CONVERTIBLE FURNITURE ASSEMBLY

[76] Inventor: Martin Borenstein, Park Bellevue Tower, 565 Bellevue Tower, Ste. 2506, Oakland, Calif. 94610

[21] Appl. No.: 945,152

[22] Filed: Sep. 15, 1992

[51] Int. Cl.[5] ..... A61G 7/05; A47C 1/00; A47C 20/00

[52] U.S. Cl. ..... 5/618; 5/507.1; 5/501; 297/423.3; 297/173; 297/161; 297/362.11; 297/397; 297/408; 297/354.13

[58] Field of Search ..... 5/618, 619, 501, 482, 5/485, 507.1; 297/161, 173, 362.11, 378.1, 378.12, 397, 408, 355, 354.13, 423.3

[56] References Cited

U.S. PATENT DOCUMENTS

| | | | |
|---|---|---|---|
| 716,209 | 12/1902 | Elliott | 297/408 |
| 1,844,291 | 2/1932 | Markutsis | 5/501 |
| 2,477,400 | 7/1949 | Beem | 5/618 |
| 2,631,300 | 3/1953 | Murray | 5/618 |
| 2,766,463 | 10/1956 | Bendersky | 5/618 |
| 3,207,555 | 9/1965 | Kerr | 297/408 |
| 3,227,693 | 12/1965 | Pruim | 5/618 |
| 3,237,986 | 3/1966 | Flint | 297/355 |
| 3,381,321 | 5/1968 | Addario | 5/485 |
| 3,465,373 | 9/1969 | Wilson | 5/618 |
| 4,095,296 | 6/1978 | Ferro | 5/618 |
| 4,168,099 | 9/1979 | Jacobs | 5/618 |
| 4,274,169 | 6/1981 | Standiford | 5/485 |
| 4,893,365 | 1/1990 | Justice | 5/618 |

FOREIGN PATENT DOCUMENTS

| | | | |
|---|---|---|---|
| 403073 | 12/1990 | European Pat. Off. | 5/618 |

OTHER PUBLICATIONS

Pamphlet for the "Ortho Adjustable Bed".

Pamphlet for the "Celebrity Adjustable Bed", Copyright 1991, Mark O. Productions, Inc. for Celebrity Choice.

Pamphlet for the "Contour Chair Lounge", Copyright 1991, Craftmatic/Contour Organization, Inc.

*Primary Examiner*—Flemming Saether

*Attorney, Agent, or Firm*—Flehr, Hohbach, Test, Albritton & Herbert

[57] ABSTRACT

A convertible furniture assembly for use on a support surface by one or two humans with backs and buttocks. The assembly includes a framework adapted to rest upon the support surface and first and second sections with proximal and distal end portions disposed on the framework. Hinge assemblies forming a pivot interconnect the proximal end portions so that the first and second sections form buttocks and back supports respectively for the humans. Arm assemblies are mounted on the framework for raising and lowering the distal end portions of the sections independent of each other about the pivot of the hinge assemblies. The sections can be moved from a coplanar and substantially horizontal position resting upon the framework, where they can form at least a part of a bed, to positions at which they are disposed at an angle with respect to each other, where they form at least a part of a lounge. A table is supported by the framework in an elevated position with respect the first section and is movable between a first position overlying the first section and a second out-of-the-way position that is not overlying the first section. The table can serve as a nightstand and a sheet and a slipcover are provided for use when the furniture assembly is converted to a bed. Serving trays and a worktable are provided for converting the furniture assembly to a dining or eating arrangement and to a desk. The furniture assembly includes a reversible central cushion which can be used with other furniture pieces.

59 Claims, 11 Drawing Sheets

MULTIPURPOSE CONVERTIBLE FURNITURE ASSEMBLY

BACKGROUND OF THE INVENTION

1. Field of the Invention.

This invention pertains generally to furniture assemblies, and more particularly to convertible furniture assemblies for use by humans.

2. Prior Art.

In the world of conventional design, where the individual pieces are of predictable shape and function, the convertible furniture assembly of the present invention, also known as the Seagull, is a revolutionary concept in comfort, convenience, and space utilization. The Seagull and the accompanying modules were designed to provide a total living environment—lounging, working, dining and sleeping—all in one elegant, multipurpose design for one or two humans. Exciting and convenient for all of us, the Seagull can be of special help to the elderly and to people who live in small spaces, and can be a necessity to the physically impaired.

Chairs and lounges for use by one or two humans have been provided which permit conversion from a position where the backs of the humans are relatively upright to a position where the humans are reclining. However, in general, these chairs and lounges do not permit the back and seat support sections to move independent of each other or to recline to a relatively horizontal position for use as a bed. Some of these chairs and lounges have back and seat support sections which are fixed with respect to each other and rock together between a first position where the back section is relatively upright and the seat section relatively horizontal and a second position where the back section is relatively reclined and the seat section is inclined so that the legs of the humans are elevated above their buttocks.

Beds have been provided which have back and seat sections which move independent of each other for reconfiguring the bed for various uses. The back and seat sections of these beds, however, do not move about a common pivot. In addition, these beds are not aesthetically suitable for use outside of the bedroom.

None of these furniture assemblies are provided with independently operable head and foot sections which pivot with respect to the back and seat support sections, or have a table mounted thereto for use therewith. In addition, these furniture assemblies do not contain components which are interchangeable or usable with other pieces of furniture, or accessories or modules which permit the furniture assemblies to be converted to a dining arrangement or a desk. Furthermore, these furniture assemblies are not easily disassembled into components which facilitate their shipping or storage.

It is in general an object of the present invention to provide a new and improved multipurpose convertible furniture assembly which can accommodate one or two humans and which overcomes the limitations and disadvantages of the convertible furniture assemblies currently provided.

Another object of the invention is to provide a convertible furniture assembly of the above character which includes back and seat support sections which are adjustable independent of each other about a common pivot.

Another object of the invention is to provide a convertible furniture assembly of the above character which is convertible between a lounge and a bed.

Another object of the invention is to provide with a convertible furniture assembly of the above character modules such as a sheet and a slipcover for use when converting the assembly to a bed.

Another object of the invention is to provide a convertible furniture assembly of the above character which includes a table for use therewith.

Another object of the invention is to provide with a convertible furniture assembly of the above character modules such as serving trays and worktables for use with the table so as to convert the assembly to a dining arrangement and a desk, respectively.

SUMMARY OF THE INVENTION

In general, the invention consists of a convertible furniture assembly for use on a support surface by one or two humans with backs and buttocks and includes a framework adapted to rest upon the support surface. The furniture assembly has first and second sections disposed on the framework, each with proximal and distal end portions, and hinge means forming a pivot interconnecting the proximal end portions of said first and second sections so that the sections form seat and back supports respectively for the humans. Means is mounted on the framework for raising and lowering the distal end portions of the first and second sections independent of each other about the pivot of the hinge means. The sections can be moved from a coplanar and substantially horizontal position resting upon the framework, where they can form at least a part of a bed, to positions at which they are disposed at an angle with respect to each other, where they form at least a part of a lounge.

The furniture assembly has a table and means secured to the framework for supporting the table in an elevated position with respect the first section and for movement between a first position overlying the first section and a second out-of-the-way position that is not overlying the first section. The table can serve as a nightstand and a sheet and a slipcover are provided for use when the furniture assembly is converted to a bed. Serving trays and a worktable are provided for converting the furniture assembly to a dining or eating arrangement and to a desk. The furniture assembly includes a reversible central cushion which can be used with other furniture pieces.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
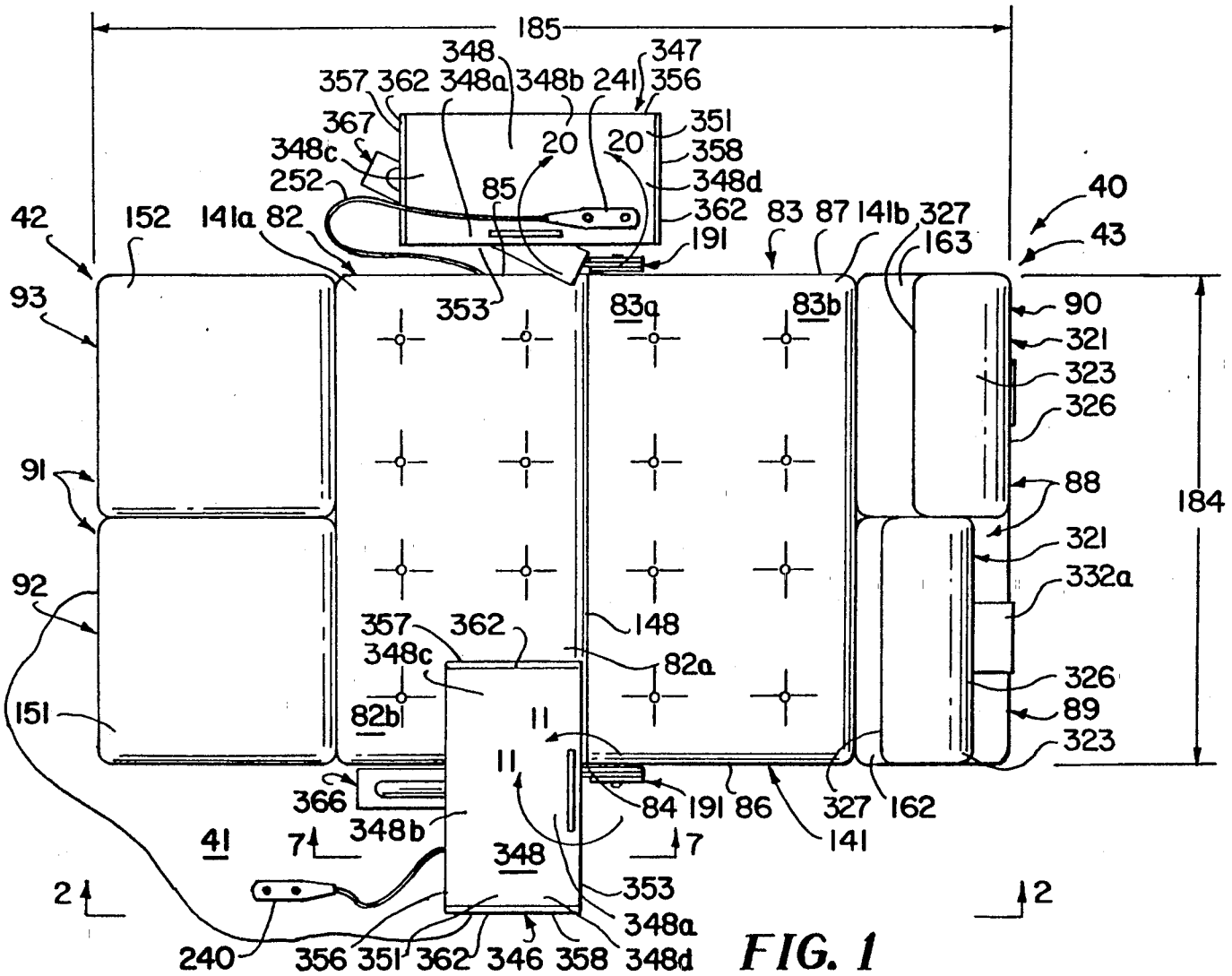
FIG. 1 is a top plan view of one embodiment of a convertible furniture assembly according to the invention.

Reference will now be made in detail to the embodiments of the invention, which are illustrated in the accompanying figures. Subtitles have been added to facilitate reading, but should not be construed as part of the text. Turning now to the drawings, wherein like components are designated by like reference numerals throughout the various figures, attention is directed to FIGS. 1 through 30.

General Overview

The convertible furniture assembly and modules for use therewith, designated generally by the reference numeral 40, is for use on a horizontal support surface 41. As shown in the drawings, convertible furniture assembly is for use by two humans with heads, backs, buttocks, legs and feet. From a side elevational view, convertible furniture assembly 40 generally resembles a seagull in flight with outstretched wings inclined at approximately 45 degrees from the horizontal. Lower wing 42 serves to support the buttocks and legs of the human, while upper wing 43 serves to support the back and head of the human (See FIG. 3). In this configuration, convertible furniture assembly 40 can be used as a lounge. The furniture assembly can also be converted into a bed, a dining arrangement and a desk, and includes modules for use in these configurations.

Two Person Multipurpose Convertible Furniture Assembly

Convertible furniture assembly 40 includes a framework 51 generally rectangular in plan formed of a suitable material such as steel. Framework 51 has first and second spaced apart parallel side members 56 and 57 with first and second end portions 56*a* and 56*b* and 57*a* and 57*b*, respectively, first and second spaced apart parallel end members 58 and 59, and a central cross-member 61 with first and second end portions 61*a* and 61*b* (See FIG. 5). End member 58 is perpendicularly joined at each end to first and second side members 56 and 57 so that end portions 56*a* and 57*a* beyond end member 58; end member 59 is perpendicularly joined at each end to end portions 56*b* and 57*b*. Cross-member 61 is perpendicularly joined near the center of side members 56 and 57 such that it is substantially parallel to end members 58 and 59 and end portions 61*a* and 61*b* protrude beyond the respective side member. Members 56, 57, 58, 59 and 61 are each hollow and rectangular in cross section and joined in a suitable manner such as welding.

As formed, framework 51 has spaced apart parallel first and second sides 62 and 63, spaced apart parallel first and second ends 66 and 67 extending substantially perpendicular to sides 62 and 63 and a substantially horizontal upper surface 68. Framework 51 is adapted to rest on a support surface 41 with legs 71 perpendicularly joined at one end to end portions 56*a*, 56*b*, 57*a* and 57*b* and having casters 72 swivelably connected at the other end for engagement with support surface 41 (See FIGS. 2 and 3).

Figure 2:
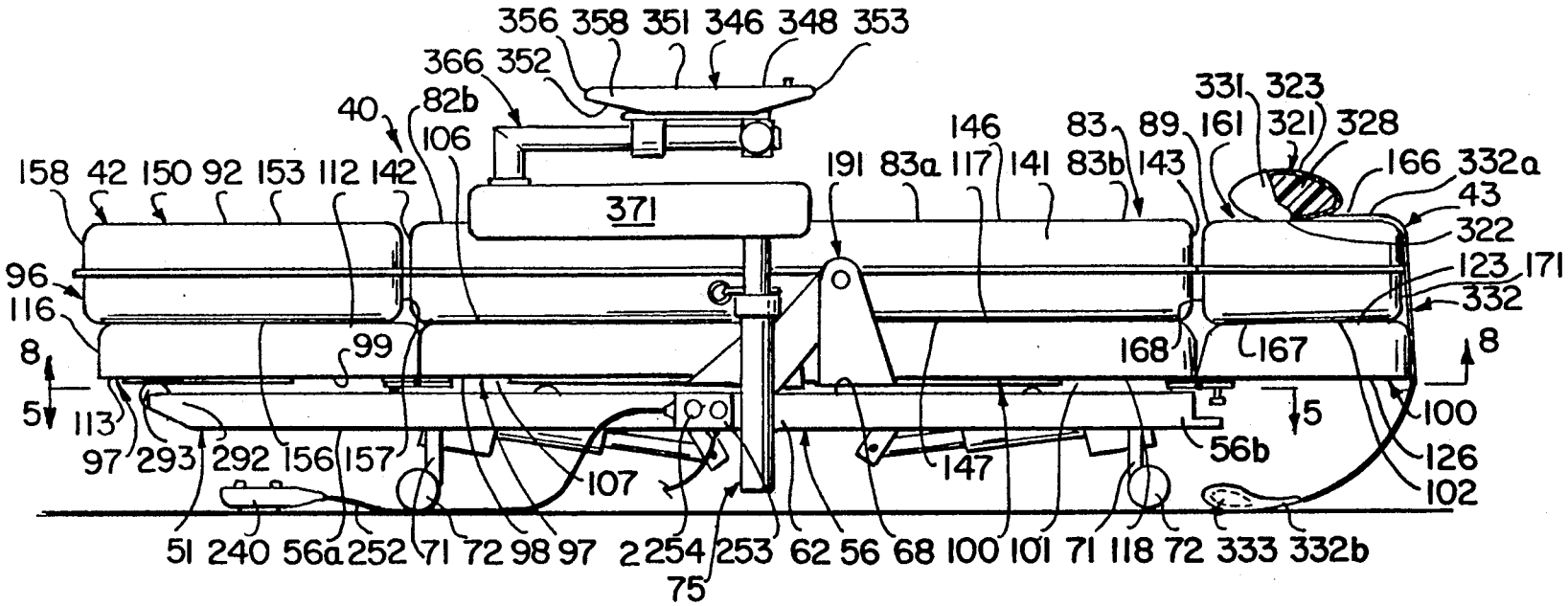
FIG. 2 is a side elevational view, partially cut away, looking along the line 2—2 in FIG. 1.
Figure 3:
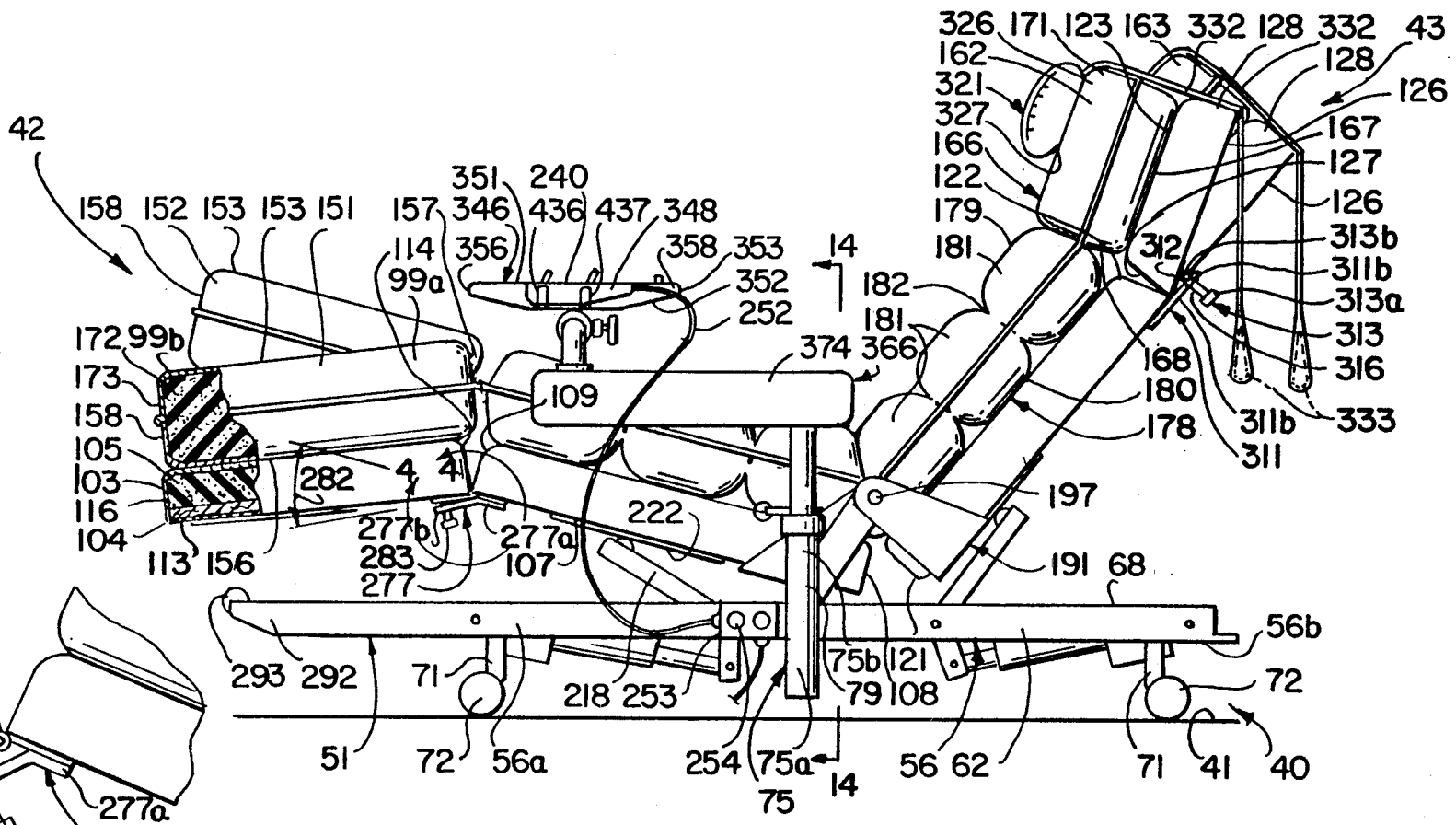
FIG. 3 is a side elevational view, partially cut away, of another embodiment of a convertible furniture assembly, substantially similar to the embodiment shown in FIG. 1, according to the invention.
Figure 4:
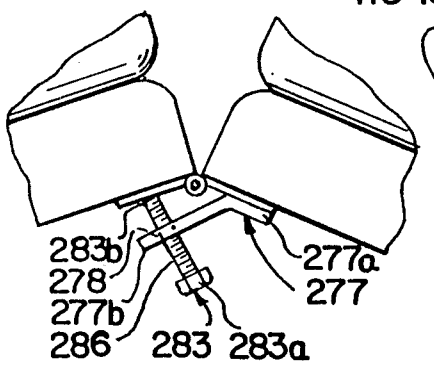
FIG. 4 is an enlarged view looking along the line 4—4 of FIG. 3.
Figure 5:
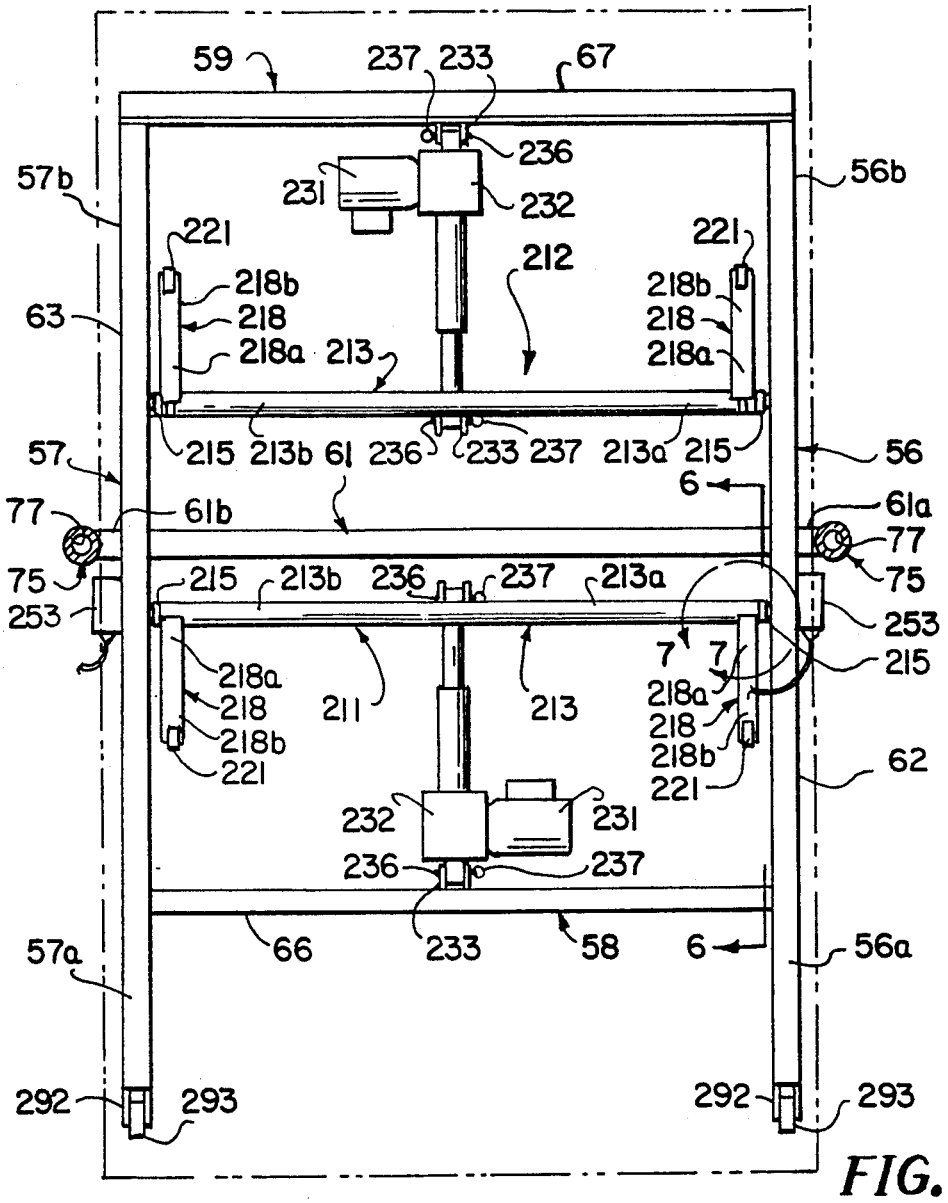
FIG. 5 is a cross-sectional view looking along the line 5—5 of FIG. 2.

An arm socket 75, made of a suitable material such as steel and having first and second end portions 75*a* and 75*b*, is joined to each of first and second sides 62 and 63 of framework 51 (See FIGS. 2, 3 and 5). A first end portion 75*a* of each arm socket is welded or otherwise suitably joined to an end portion 61*a* or 61*b* of central cross-member 61 such that arm sockets 75 are in a substantially vertical and upright position with respect to support surface 41 and substantially perpendicular to upper surface 68 of framework 51. A second end portion 75*b* has a top surface 76. Arm socket 75 is in the shape of a tubular post and is provided with a central bore 77 which extends along a central longitudinal axis 78 and is circular in cross section. A steel pivot bracket 79 provided with a bore 80 at one end thereof is welded or otherwise suitably joined at the other end thereof to each end portion 75b and overhangs and projects from arm socket 75 in a direction substantially parallel to sides 62 and 63 of framework 51 and towards second end 67 (See FIGS. 9 and 10).

Lower and upper wings 42 and 43 are disposed on framework 51 and are long and wide enough to support one or two humans thereon. It should be appreciated, however, that convertible furniture assembly 40 can be used by one human and in some situations by more than two humans. In general, lower wing 42 includes a first section in the form of buttocks or seat section 82 which forms a seat support for the humans, and upper wing 43 includes a second section in the form of back section 83 which forms a back support for the humans (See FIGS. 1 and 2). Seat section 82 has proximal and distal end portions 82a and 82b and first and second opposite sides 84 and 85. Back section 83 has proximal and distal end portions 83a and 83b and first and second opposite sides 86 and 87. A head section 88 for supporting the heads of the humans and formed of first and second separately movable parts 89 and 90, one part for each head of the two humans, is connected to distal end portion 83b of back section 83. A leg and foot section 91 for supporting the legs and feet of the humans and formed of first and second separately movable parts 92 and 93, one part provided for each of the legs and feet of one human, is connected to distal end portion 82b of seat section 82.

More specifically, lower and upper wings 42 and 43 have a rectangularly shaped and segmented foundation 96 mounted on framework 51 comprised of a first section in the form of lower wing section 97 with separate proximal or seat and distal or foot portions 98 and 99 and a second section in the form of upper wing section 100 with separate proximal or back and distal or head portions 101 and 102 (See FIGS. 2 and 3). Foot and head portions 99 and 102 are each formed from first and second separate parts 99a and 99b and 102a and 102b, respectively, which, in each case, are substantially identical. Each of the portions of foundation 96, and parts thereof, is substantially rectangular in plan and is formed from a covering 103, made from a suitable material such as leather, vinyl or cloth, with a base 104 and padding 105 inside covering 103. Base 104 is made of a suitable material such as wood, while padding 105 is made of a suitable material such as foam. Covering 103 can be zipped in place to permit ease of removal thereof. Seat portion 98 of lower wing section 97 has top and bottom surfaces 106 and 107 and proximal and distal ends 108 and 109; each part 99a and 99b of foot portion 99 has top and bottom surfaces 112 and 113 and proximal and distal ends 114 and 116. Similarly, back portion 101 of upper wing section 100 has top and bottom surfaces 117 and 118 and proximal and distal ends 121 and 122; each part 102a and 102b of head portion 102 has top and bottom surfaces 123 and 126 and proximal and distal ends 127 and 128. Top surfaces 106, 112, 117 and 123 form the top surface of foundation 96, while bottom surfaces 107, 113, 118 and 126 form the bottom surface of foundation 96.

Cushions are disposed on the upper surface of segmented foundation 96 as illustrated in FIGS. 2 and 3. Lower and upper wing sections 97 and 100 have an upper portion which includes a foldable and reversible central cushion 141 for supporting humans. Cushion 141 forms the upper portion of both seat and back sections 82 and 83, and has first and second portions 141a and 141b of approximately equal size, first and second opposite ends 142 and 143 and first and second opposite surfaces 146 and 147. Surfaces 146 and 147 each have a crease 148 therein which divides central cushion 141 into first and second portions 141a and 141b.

A foot cushion 150 is adjacent first end 142 of central cushion 141. Cushion 150 is formed in first and second separate parts 151 and 152, with one part for the feet of each human. Each part 151 and 152 is substantially equivalent in proportion and has top and bottom surfaces 153 and 156 and proximal and distal ends 157 and 158, with proximal end 157 facing first end 142 of central cushion 141.

Similarly, a head cushion 161 is adjacent second end 143 of central cushion 141. Cushion 161 is formed in first and second separate parts 162 and 163, with one part for the head of each human. Each part 162 and 163 of head cushion 161 is substantially in proportion and has top and bottom surfaces 166 and 167 and proximal and distal ends 168 and 171, with proximal end 168 facing second end 143 of central cushion 141.

Cushion 141, parts 151 and 152 of foot cushion 150, and parts 162 and 163 of head cushion 161 are each formed from a suitable padding 172 such as foam with a covering 173 made from a suitable material such as leather, vinyl or cloth thereover. Covering 173 can be made from the same material as covering 103 for foundation 96, and has a zipper thereon hidden from view for access to and removal of padding 172.

The cushions are each generally rectangular in plan and sized to fit the plan dimensions of the related portion or part of foundation 96. Foot cushion 150 is disposed on foot portion 99, first and second parts 151 and 152 of the foot cushion on first and second parts 99a and 99b of the distal portion, with bottom surface 156 attached to top surface 112 by a suitable removable means such as a zipper. Similarly, head cushion 161 is disposed on head portion 102, first and second parts 162 and 163 of the head cushion on first and second parts 102a and 102b of the distal portion, with bottom surface 167 attached to top surface 123 by a suitable removable means such as a zipper.

Central cushion 141 is sandwiched between foot and head cushions 150 and 161. First or second surface 146 or 147 abuts top surfaces 106 and 117 of the proximal portions of lower and upper wing foundation sections 97 and 100, with first and second portions 141a and 141b of central cushion 141 disposed on seat and back portions 98 and 101 of foundation 96. In FIGS. 1 and 2, first portion 141a is disposed on top surface 106 of lower wing section 97 and second portion 141b is disposed on top surface 117 of upper wing section 100; second surface 147 is positioned downwardly facing segmented foundation 96.

The seat, back, head and foot sections are each generally formed by a cushion, or portion thereof, and the related portion of the foundation. Seat section 82 is formed by seat portion 98 of lower wing foundation section 97 and first portion 141a of central cushion 141, and back section 83 is formed by back portion 101 of upper wing foundation section 100 and second portion 141b of central cushion 141. First or upper surface of seat section 82 is formed by first surface 146 of first portion 141a of central cushion 141, while second or lower surface of seat section 82 is formed by bottom surface 107 of seat portion 98 of foundation 96. Similarly, first or upper surface of back section 83 is formed by first surface 146 of second portion 141b, while second or lower surface of back section 83 is formed by bottom surface 118 of back portion 101.

Foot portion 99 of lower wing foundation section 97 together with foot cushion 150 form leg and foot section 91. Head portion 102 of upper wing foundation section 100 together with head cushion 161 form head section 88. Leg and foot section 91 has a first or top surface formed by top surface 153, a second or bottom surface formed by bottom surface 113 and a distal end formed by distal ends 116 and 158. Head section 88 has a first or top surface formed by top surface 166, a second or bottom surface formed by bottom surface 126 and a distal end formed by distal ends 128 and 171.

First and second surfaces 146 and 147 of portions **141*a* and 141*b* of central cushion 141 and top surfaces 153 and 166 of foot and head cushions 150 and 161 are generally planar, although surfaces of other conformation are within the scope of the present invention. For example, in the alternate embodiment of convertible furniture assembly 40 illustrated in FIG. 3, alternate central cushion 178 has first and second surfaces 179 and 180 formed from a series of rolls 181 separated by creases 182**.

When viewed in plan, convertible furniture assembly 40 has a width and length indicated by width and length dimensions 184 and 185 shown in FIG. 1. In the preferred embodiment of convertible furniture assembly 40, width and length dimensions 184 and 185 are approximately 39 and 78 inches, respectively, the approximate dimensions of a standard twin bed. It should be appreciated, however, that width and length dimensions 184 and 185 can approximate the dimensions of other standard beds or furniture pieces, or have other dimensions which accommodate humans, and be within the scope of the present invention.

First hinge assembly 191 disposed on first sides 84 and 86 of seat and back sections 82 and 83, respectively, and second hinge assembly 192 disposed on second sides 85 and 87 of seat and back sections 82 and 83, respectively, which are opposite first sides 84 and 86, serve as hinge means forming a pivot interconnecting proximal end portions **82*a* and 83*a* (See FIG. 1). As illustrated in FIGS. 2 and 3, seat and back sections 82 and 83 form buttocks and back supports respectively for the two humans. Hinge assemblies 191 and 192 each include first and second leaves 193 and 196 for fastening on seat and back sections 82 and 83, respectively, a single removable interconnecting member such as bolt 197 which serves as a pivot for the hinge assemblies, and a nut 198 for securing bolt 197 thereto (See FIGS. 8 through 10). Leaves 193 and 196, in turn, each are generally "L" shaped and have mounting portions 193*a* and 196*a* and arm portions 193*b* and 196*b*, respectively, which join at substantially right angles. Arm portions 193*b* and 196*b* each have a bore 201** at the end thereof.

Hinge assemblies 191 and 192 are each fastened to sections 82 and 83 and connected to framework 51 in a substantially identical manner. For simplicity, this manner of fastening and connecting is described only with respect to hinge assembly 191. Mounting portion **193*a* is disposed on bottom surface 107 near first side 84 and proximal end 108 and fastened to seat portion 98 of foundation 96 by screws 202 which are countersunk in the mounting portion and protrude through covering 103 to secure to base 104. Similarly, mounting portion 196*a* is disposed on bottom surface 118 near first side 86 and proximal end 121 and fastened to back portion 101 in substantially the same manner as mounting portion 193*a* is fastened to seat portion 98. Arm portions 193*b* and 196*b* extend from bottom surfaces 107 and 118 on opposite sides of pivot bracket 79 towards first surface 146 of central cushion 141 and are fastened together and to pivot bracket 79 by bolt 197 which extends through bore 201 in arm portion 196*b*, bore 80 in pivot bracket 79 and bore 201 in arm portion 193*b* and is secured therein by nut 198. As assembled, hinge assemblies 191 and 192 serve to interconnect seat and back sections 82 and 83 to framework 51 and have a pivot in the form of bolt 197 approximately equidistant between the first (surface 146 of central cushion 141) and second (bottom surfaces 107 and 118) surfaces of sections 82 and 83**.

Figure 6:
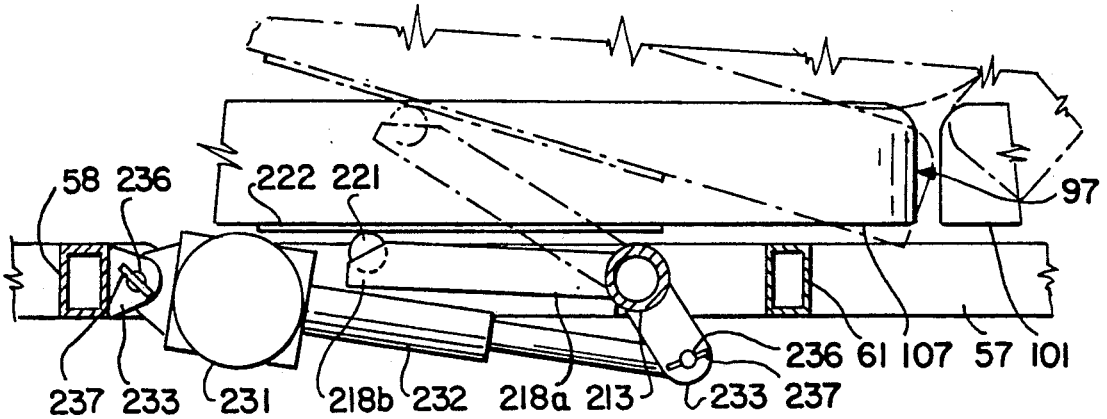
FIG. 6 is a cross-sectional view looking along the line 6—6 of FIG. 5.
Figure 7:
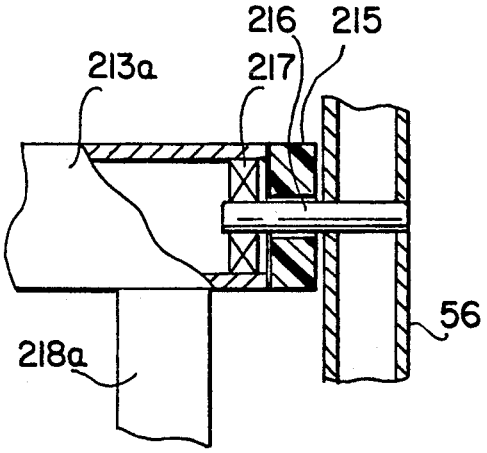
FIG. 7 is an enlarged view, partially cut away, looking along the line 7—7 of FIG. 5.

Means is mounted on framework 51 for raising and lowering distal end portions **82*b* and 83*b* independent of each other about bolt 197 and includes first and second arm assemblies 211 and 212 each having an elongate cross member such as hollow bar 213 rotatably mounted between side members 56 and 57 of framework 51 substantially parallel to end members 58 and 9 (See FIGS. 5 and 6). First arm assembly 211 is for seat section 82 and second arm assembly 212 is for back section 83. Bars 213 are made of a suitable material such as steel and have first and second end portions 213*a* and 213*b*. Means for mounting each bar 213 to framework 51 includes ring shaped spacers 215 made of nylon or any other suitable material which are slidably mounted on aligned and opposed cylinders 216 threadedly fastened in bores provided in side members 56 and 57, and bearings 217 with inner races which are mounted on cylinders 216 and outer races which are mounted within end portions 213*a* and 213*b* (See FIG. 7**).

Each bar 213 has two aligned arms in the form of lifters 218 joined to end portions **213*a* and 213*b* in spaced apart position for engaging the respective section 82 or 83. Lifter 218 are made of a suitable material such as steel and can be hollow. Each such lifter 218 for seat and back sections 82 and 83 has a proximal end 218*a* pivotally coupled to framework 51 by being welded or otherwise suitably joined to an end portion 213*a* or 213*b*, and a distal end 218*b* with roller means such as roller 221 fastened thereto for slidably engaging the respective section 82 or 83. Seat and back sections 82 and 83 have an elongate strip 222 fastened on bottom surfaces 107 and 118, respectively, for each roller 221 to engage. Each strip 22 is aligned substantially parallel to sides 84 through 87 so that the related roller 221 travels thereon as sections 82 and 83 are raised and lowered (See FIG. 8**).

The means for raising and lowering distal end portions **82*b* and 83*b* also includes motive means for causing pivotal movement of lifters 218 to cause pivotal movement of the respective section 82 or 83. Electric motors 231 mounted on framework 51 and remote control means for operating motors 231 serve as motive means for causing pivotal movement of lifters 218. A separate motor 231 is provided for each arm assembly 211 and 212 as illustrated in FIG. 5. Further included in the means for raising and lowering distal end portions 82*b* and 82*b* is means for coupling each motor 231 to related bar 213 to cause rotation of the bar 213 in one direction for raising the related distal end portion 82*b* or 83*b* and rotation of the bar 213 in an opposite direction for lowering the related distal end portion 82*b* or 83*b*. A liner actuator 232 connected at one end to the approximate middle of first end member 58 with respect to seat section 82 or to the approximate middle of second end member 59 with respect to back section 83 and at the other end to the approximate middle of the related bar 213 is a suitable means for coupling a motor 231 to the related bar 213. Each end member 58 and 59 and each bar 213 has a bracket 233 at the approximate middle thereof, and actuator 232 is removably fastened at each end to a bracket 233 by a removable pin 236 and a fastening element in the form of clip 237. A motor and linear actuator by Dayton can be used for motor and actuator 231 and 232**.

Convertible furniture assembly 40 has means for controlling the raising and lowering of distal end portions **82*b* and 83*b* which is accessible to the humans when they are being supported by seat and back sections 82 and 83. Movable first and second hand units 240 and 241 are part of the means for controlling the raising and lowering and the remote control means for operating motors 231 (See FIGS. 21 and 22). Hand units 240 and 241 are each formed from an elongate casing 242, which is contoured to be easily held by a human hand, having first and second surfaces 243 and 244. First and second switches 247 and 248 are located on first surface 243 for raising and lowering distal end portions 82*b* and 83*b*, respectively. A safety switch 249 is inset in second surface 244 and must be engaged to permit lowering of either seat or back sections 82 or 83. It should be appreciated that the control means and/or remote control means discussed above could be secured to framework 51, seat or back sections 82 or 83 or another part of convertible furniture assembly 40** and be within the scope of the present invention.

Means for controlling the raising and lowering and the remote control means for motor 231 also include cable means such as cable 252 to permit, among other things, placement of hand units 240 and 241 in positions away from convertible furniture assembly 40. Each cable 252 is connected to framework 51 at a junction box 253, as illustrated in FIGS. 2 and 3, which includes an electrical outlet or receptacle 254 for operating electronic equipment, lamps and other devices requiring alternating current on and about convertible furniture assembly 40. As an alternative to the embodiment shown in the drawings, the control means and the remote control means could include a hand unit which operates as a wireless remote and be within the scope of the present invention. In addition, although electrical receptacles 254 are shown in the drawings as being centrally located on framework 51 in junction box 253, additional and/or alternative electrical receptacles 254 can be included elsewhere on convertible furniture assembly 40.

Figure 8:
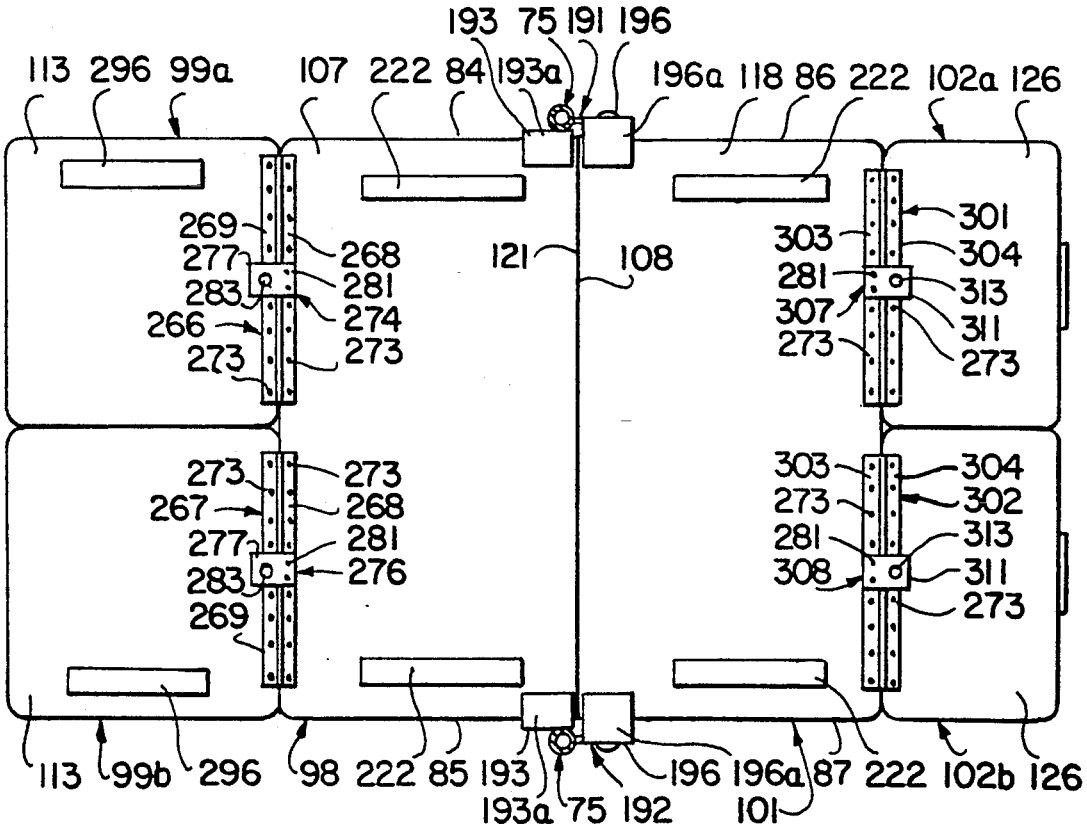
FIG. 8 is a cross-sectional view looking along the line 8—8 of FIG. 2.
Figure 10:
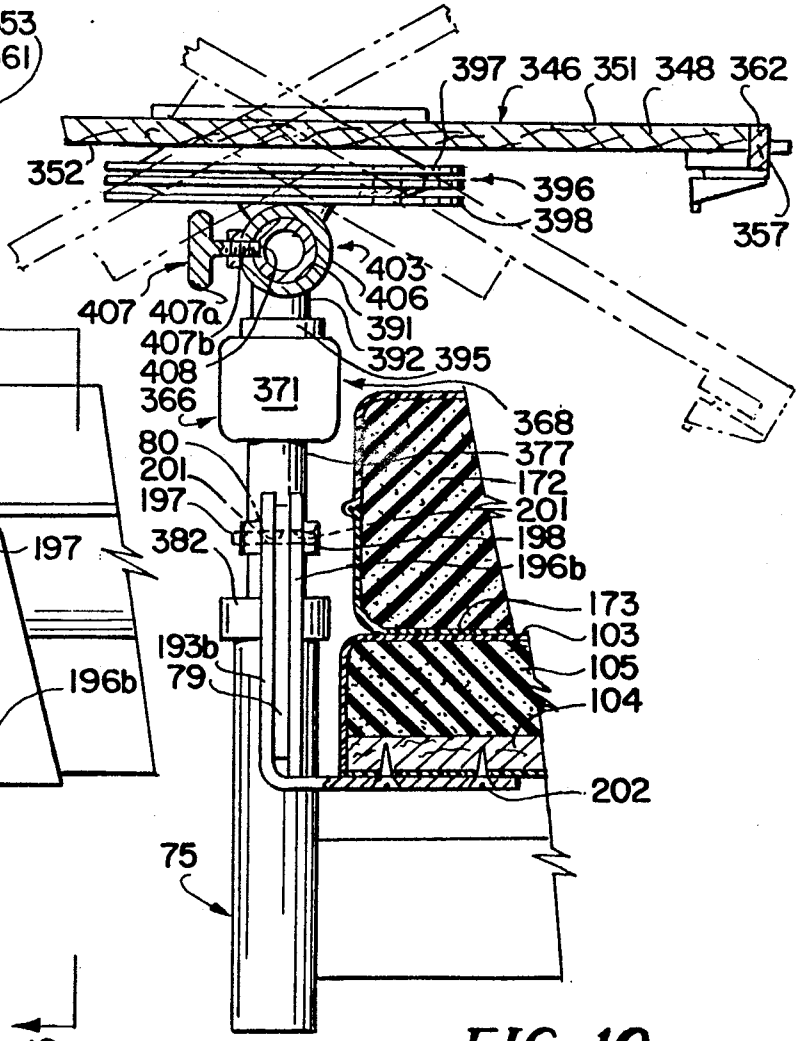
FIG. 10 is a cross-sectional view of a portion of FIG. 9 looking along the line 10—10 of FIG. 9.
Figure 9:
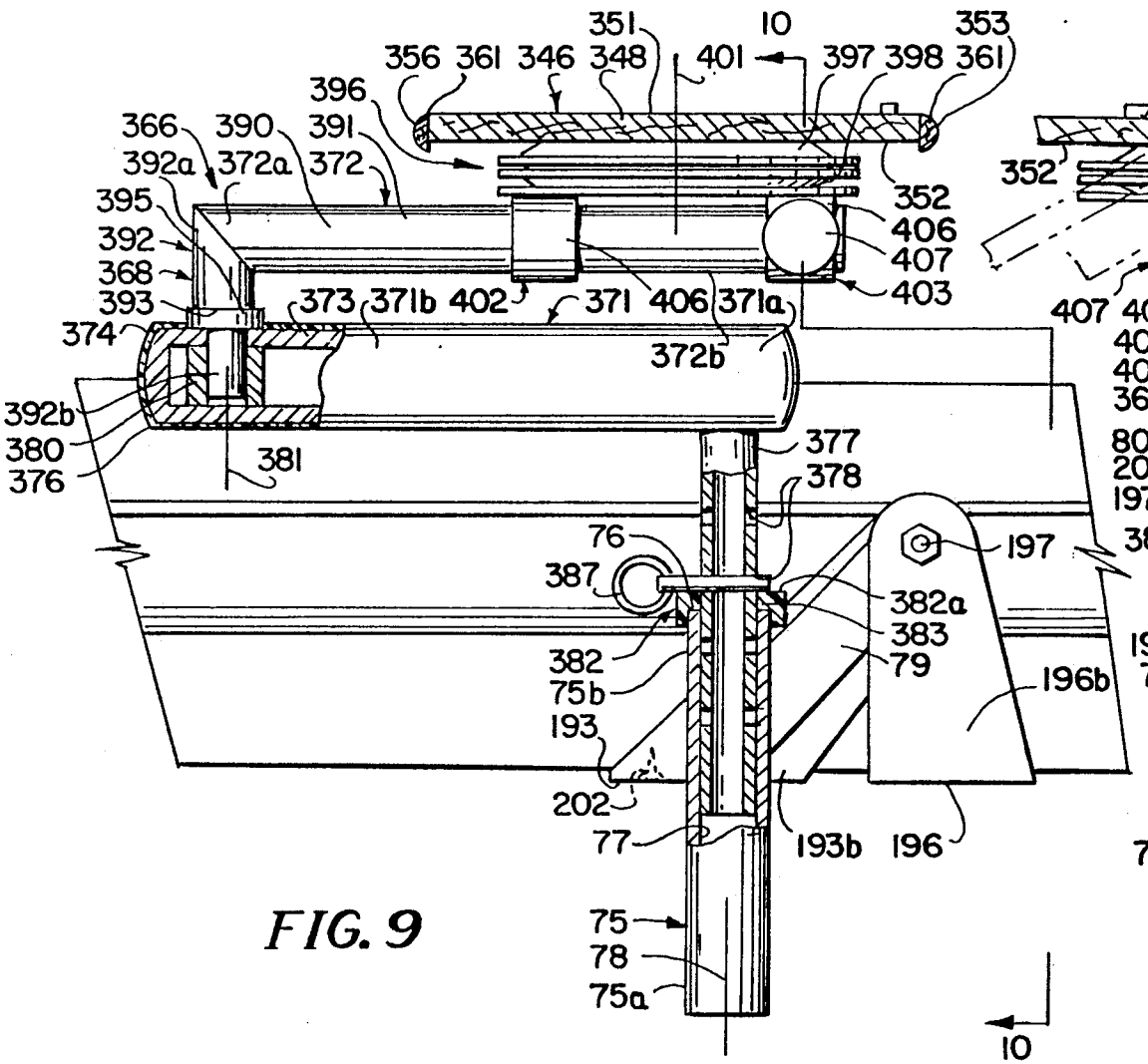
FIG. 9 is a cross-sectional view looking along the line 9—9 of FIG. 1.
Figure 11:
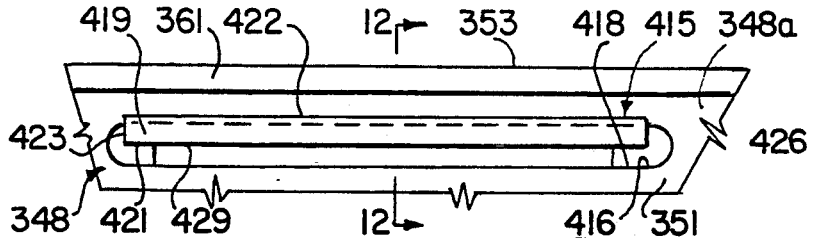
FIG. 11 is an enlarged view lookinq along the line 11—11 of FIG. 1, and rotated 90 degrees.

Means for pivotally connecting distal end portion **82*b* of seat section 82 to leg and foot section 91 includes first and second hinge assemblies 266 and 267 which permit first and second parts 92 and 93 of the leg and foot section to pivot downwardly independent of each other with respect to the seat section (See FIG. 8). First hinge assembly 266 connects seat section 82 to first part 92 of the leg and foot section and includes first and second elongate leaves 268 and 269. First leaf 268 is disposed on bottom surface 107 of seat foundation portion 98 and second leaf 269 is disposed on bottom surface 113 of first part 92 of distal foundation portion 99*a*. Second hinge assembly 267 connects seat section 82 to second part 93 of the leg and foot section and includes first and second elongate leaves 268 and 269, with first leaf 268 disposed on bottom surface 107 and second leaf 269 disposed on bottom surface 113 of second part 93. Each of leaves 268 and 269 is fastened to the respective portion of foundation 96 by screws 273 which are countersunk in the leaf and protrude through covering 103 to secure to base 104 in substantially the same manner as shown in FIGS. 9 and 10**.

The means for pivotally connecting distal end portion **82*b* of seat section 82 to leg and foot section 91 also includes first and second adjustment assemblies 274 and 276 which serve as means for pivoting first and second parts 92 and 93, respectively, of leg and foot section 91 with respect to seat section 82. Each of the adjustment assemblies includes a rectangular plate 277 with a first planar portion 277*a* secured to seat section 82 and a second planar portion 277*b* provided with a bore 278 therein. First portion 277*a* is fastened to first leaf 268 and seat portion 98 by suitable means such as screws 281 and is inclined with respect to second portion 277*b* at an angle indicated by angle 282 in FIG. 3 and ranging from 20 to 70 degrees. An adjustment member such as bolt 283 is mounted in bore 278 of plate 277 and has a head portion 283*a* for gripping and an end portion 283*b* which engages second leaf 269 on leg and foot section 91 (See FIG. 4**).

Bore 278 and bolt 283 are each provided with cooperatively mating threads 286 which act as means for adjusting bolt 283 with respect to plate 277. Rotational movement of bolt head portion **283*a* with respect to plate 277 in one direction causes pivotal movement of leg and foot section 91 in one direction, and rotational movement of bolt head portion 283*a* in an opposite direction causes pivotal movement of leg and foot section 91 in an opposite direction. More specifically, clockwise rotation of bolt 283 within bore 278 causes leg and foot section 91 to pivot upwardly towards a position coplanar with seat section 82, while counterclockwise rotation of bolt 283 within bore 278 causes the leg and foot section to pivot downwardly with respect to the seat section. Leg and foot section 91 is limited in downward travel by second portion 277*b* of plate 277, and can not exceed angle 282 from its coplanar position with seat section 82**.

Framework 51 includes brackets 292 joined thereto with rollers 293 connected to the brackets which act as means for retaining leg and foot section 91 in a position coplanar with seat section 82 when the seat section is lowered to a horizontal position. Brackets 292 are joined to first end portions **56*a* and 57*a* of side members 56 and 57 in a position colinear therewith. Bottom surfaces 113 of first and second parts 92 and 93 of head and foot section 91 each have an elongate strip 296 formed of a suitable material such as steel fastened thereto in a position substantially perpendicular to distal ends 116. Rollers 293 engage strips 296 and travel thereon as necessary as seat section 82 is lowered to a substantially horizontal position on framework 51**.

Means for pivotally connecting distal end portion **83*b* of back section 83 to head section 88 includes first and second hinge assemblies 301 and 302 which permit first and second parts 89 and 90 of the head section to pivot upwardly independent of each other with respect to the back section (See FIG. 8). First hinge assembly 301 connects back section 83 to first part 89 of the head section and includes first and second elongate leaves 303 and 304. First leaf 303 is disposed on bottom surface 118 of back foundation portion 101 and second leaf 304 disposed on bottom surface 126 of first part 89 of head foundation portion 102*a*. Second hinge assembly 302 connects back section 83 to second part 90** of the head section and includes first and second elongate leaves 303 and 304, with first leaf 303 disposed on bottom surface 118 and second leaf 304 disposed on bottom surface 126 for second part 90. Each of leaves 303 and 304 is fastened to the respective portion of foundation 96 by screws 273 in the same manner as discussed above with respect to leaves 268 and 269.

The means for pivotally connecting distal end portion 83*b* of back section 83 to head section 88 also includes first and second adjustment assemblies 307 and 308 which serve as means for pivoting first and second parts 89 and 90, respectively, of head section 88 with respect to back section 83. Each of the adjustment assemblies includes a rectangular planar plate 311 with a first portion 311*a* secured to back section 83 and a second portion 311*b* provided with a bore 312 therein. First portion 311*a* is fastened to first leaf 303 and back portion 101 by suitable means such as screws 281. An adjustment member such as bolt 313 is mounted in bore 312 of plate 311 and has a head portion 313*a* for gripping and an end portion 313*b* which engages second leaf 304 on head section 88.

Bore 312 and bolt 313 are substantially similar to bore and bolt 278 and 283 and are each provided with cooperatively mating threads 316 substantially similar to threads 286 which act as means for adjusting bolt 313 with respect to plate 311. Rotational movement of bolt head portion 313*a* with respect to plate 311 in one direction causes pivotal movement of head section 88 in one direction, and rotational movement of bolt head portion 313*a* in an opposite direction causes pivotal movement of head section 88 in an opposite direction. More specifically, clockwise rotation of bolt 313 within bore 312 causes head section 88 to pivot upwardly with respect to back section 83, while counterclockwise rotation of bolt 313 within bore 312 causes the head section to pivot downwardly towards a position coplanar with the back section. Head section 88 is limited in downward travel by second portion 311*b* of coplanar plate 311.

A head rest or pillow 321 is movably disposed on top surface 166 of each of first and second parts 89 and 90 of head section 88 (See FIGS. 1 through 3 and FIGS. 26 and 27). Each pillow 321 has a length substantially equivalent to the width of the related part 89 or 90 and has a substantially planar bottom surface 322 which engages top surface 166 and an arcuate top surface 323 on which a human head can rest. Bottom and top surfaces 322 and 323 meet at first and second ends 326 and 327. Pillows are each formed from a suitable padding 328 such as foam with a covering 331 such as leather, vinyl or cloth thereover. Covering 331 can be formed from the same material as coverings 173 and/or 103, and has a zipper thereon hidden from view for access to and removal of padding 328.

Weight means consisting of flexible strip 332 and weight 333 extends over and frictionally engages head section 88 and serves as a counterbalance to pillow 321 so that the pillow is retained in a position to which it is moved. Strip 332 has a first end portion 332*a* connected to pillow at first end 326 and a second end portion 332*b* with weight 333 therein. Most desirably, strip 332 is made of the same material as covering 331.

Convertible furniture assembly 40 includes planar support members such as first and second tables 346 and 347 for use by the two humans when they are seated on the convertible furniture assembly. Each table 346 and 347 includes a board 348 which is substantially rectangular in plan and made of a suitable material such as wood. Each board 348 has first and second side portions 348*a* and 348*b*, first and second end portions 348*c* and 348*d*, first or top and second or bottom opposite surfaces 351 and 352, first and second opposite rounded sides 353 and 356, and first and second opposite ends 357 and 358 (See FIGS. 1, 9 and 10). Board 348 includes trim 361 on sides 353 and 356 and trim 362 on ends 357 and 358.

Figure 14:
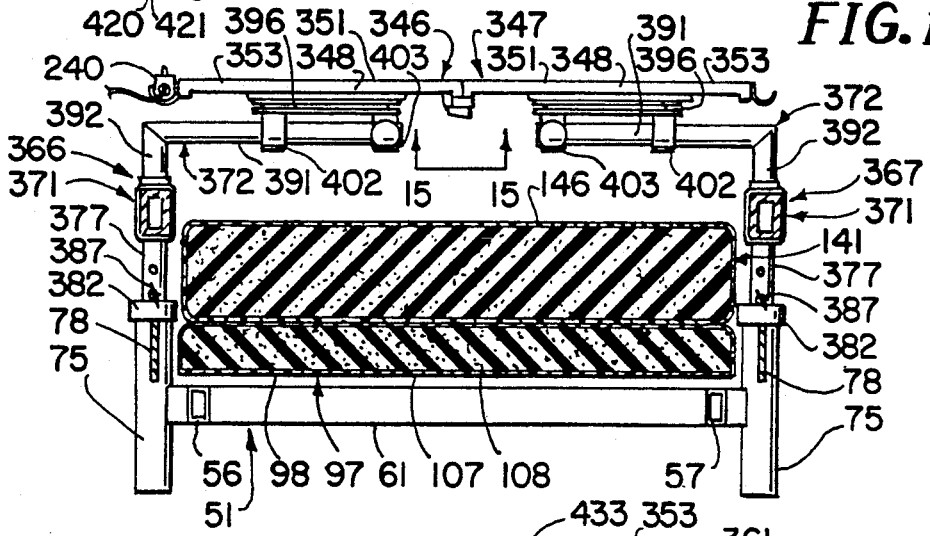
FIG. 14 is a cross-sectional view looking along the line 14—14 of FIG. 3.
Figure 26:
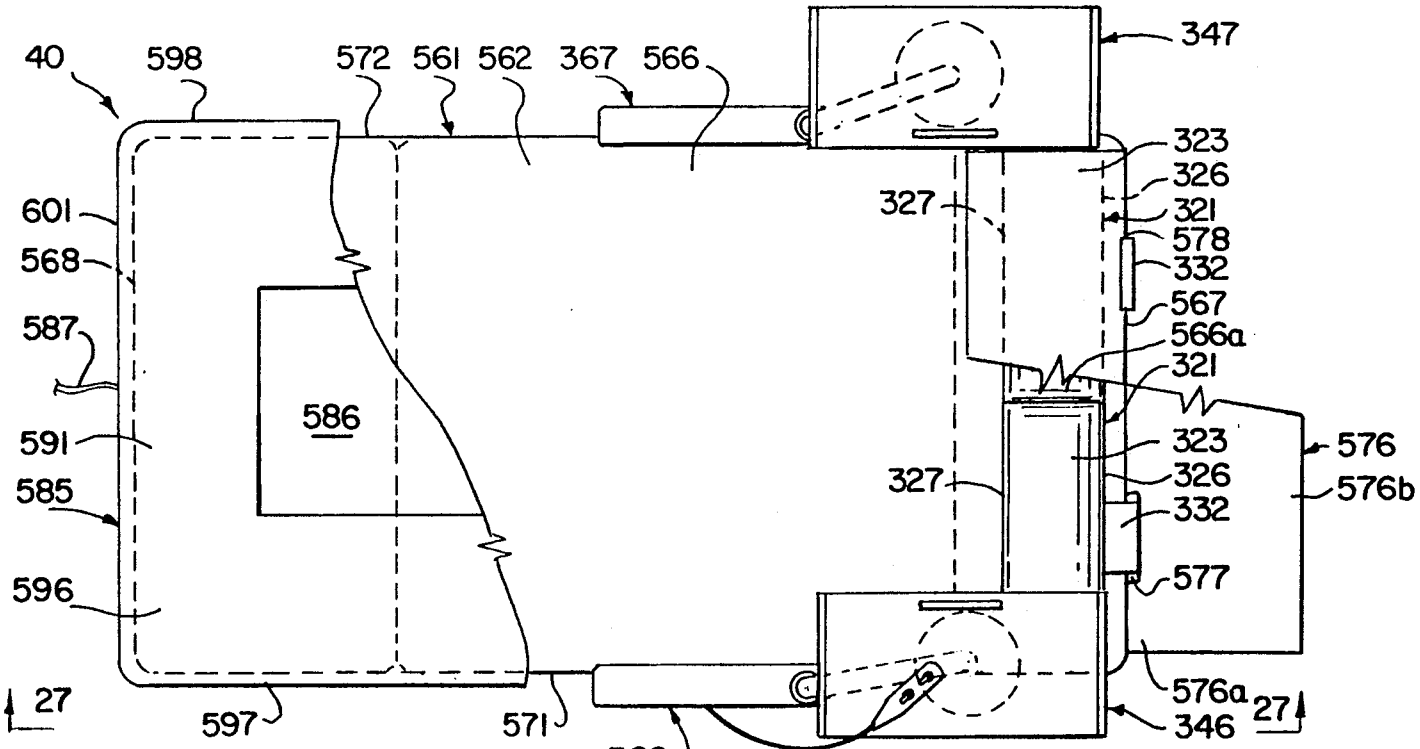
FIG. 26 is a top plan view, similar to FIG. 1, of another embodiment of a portion of the convertible furniture assembly according to the invention.

First and second tables 346 and 347 are mounted to framework 51 in a manner which permits movement between a first position overlying seat section 82 and a second out-of-the-way position not overlying seat section 82. For example, FIG. 1 shows first table 346 in an elevated position overlying seat section 82 and FIGS. 3 and 14 show both tables 346 and 347 in elevated positions overlying the seat section. FIG. 1 shows second table 347 in a second out-of-the-way position, and FIG. 26 shows both tables 346 and 347 in second out-of-the-way positions being used as nightstands with first table 346 partially overlying back section 83 and second table 347 in a position adjacent the back section.

First and second arm assemblies 366 and 367 serve as means for mounting tables 346 and 347 to framework 51 and means secured to one side of framework 51 for supporting the tables in an elevated position with respect to seat section 82 (See FIGS. 9 and 10). Each assembly 366 and 367 includes an arm 368 formed from an axially elongated first or lower arm section 371 pivotally coupled to framework 5 and an axially elongated second or upper arm section 372 pivotally coupled to the lower arm section.

Lower arm section 371 has first and second end portions 371*a* and 371*b* and includes an elongate hollow frame element 373 made of a suitable material such as steel and substantially parallel to upper surface 68 of framework 51. Frame element 373 has a covering 376 thereover, made from a suitable material such as leather, vinyl or cloth, which forms top surface 374 of lower arm section 371. First end portion 371*a* includes a tube 377 formed from a suitable materials such as steel welded or otherwise suitably joined to frame element 373 at a substantially right angle. Tube 377 is substantially vertical with respect to upper surface 68 and is provided with a plurality of transverse bores 378 across the diameter thereof. Second end portion 371*b* is provided with a tubular shaped steel receptacle 380. Receptacle 380 is substantially vertical with respect to upper surface 68 of framework 51 and has a central longitudinal axis 381.

Tube 377 is removably disposed in bore 77 in second end portion 75*b* and thereby concentrically carried by arm socket 75 joined to framework 51 to permit pivoting of arm 368 with respect to the framework about central longitudinal axis 78 of arm socket 75 in a substantially horizontal plane. An annular spacer made of a suitable material with a relatively low coefficient of friction, such as nylon, and having an inwardly protruding rim 383 at one end portion 382*a* thereof for riding on top surface 76 of second end portion 75*b* is concentrically carried by arm socket 75 for engagement with tube 377. A removable metal pin 387 is carried by a bore 378 in tube 377 and protrudes from each end of bore 378 to ride on end portion 382*a* of spacer 382 and, consequently, bear on top surface 76 of arm socket 75. In this manner, tube 377 is elevationally locked with respect to arm socket 75.

Pin 387 and bores 378 act as means for adjusting the height of tables 346 and 347 above support surface 41, with pin 387 serving as an adjustment member and bores 378 serving as adjustment bores. Pin 387 can be moved between bores 378 to raise or lower the height of tables 346 and 347 with respect to support surface 41. By way of example, pin 387 is moved to and inserted in a bore 378 higher up arm socket 75 to lower the related table. Tube 377 is pulled upwardly from arm socket 75, thereby exposing additional bores 378, and pin 387 moved to and inserted in another bore 378 lower in arm socket 75 to raise the related table.

Upper arm section 372 has first and second end portions 372*a* and 372*b* and a central longitudinal axis 390, and includes an elongate element 391 substantially centered along axis 390 and parallel to upper surface 68 of framework 51. Elongate element 391 is tubular in conformation and made of a suitable material such as steel. First end portion 372*a* includes a tube 392 also made of a suitable material such as steel with a first end part 392*a* welded or otherwise suitably joined at a substantially right angle to one end of elongate element 391 and a second end part 392*b* of a reduced diameter separated from first end part 392*a* by stop surface 393. Tube 392 is substantially vertical with respect to upper surface 68 of framework 51, with second end part 392*b* mounted in receptacle 380 in second end portion 371*b* with a sliding fit to permit pivoting of upper arm section 372 with respect to lower arm section 371 about central longitudinal axis 381 of receptacle 380 in a substantially horizontal plane. An annular spacer 395 made of a suitable material with a relatively low coefficient of friction, such as nylon, is carried by tube 392 and sandwiched between receptacle 380 and stop surface 393 to facilitate such pivotal movement of upper arm section 372.

Although upper arm section 372 is shown in the drawings as not being adjustable in height with respect to lower arm section 371, second end part 392*b* of the upper arm section could be provided with bores similar to bores 378 in tube 377 of lower arm section 371 and, together with a pin similar to pin 387 which rides on annular spacer 395, serve as means for adjusting the height of upper arm section 372 with respect to lower arm section 371.

First and second arm assemblies 366 and 367 also each include means for pivotally coupling board 348 of the related first or second table 346 or 347 to arm 368 which consists of swivel 396 and clamping means for fastening swivel 396 to arm 368. Swivel 397 is formed from first and second metal disks 397 and 398 which are coupled together in a manner known to those skilled in the art to permit relative rotation of the two disks and pivoting of board 348 about an axis 401 substantially perpendicular to elongate element 391 of upper arm section 372. First disk 397 is fastened on the planar central portion of bottom surface 352 of board 348 by a suitable means such as screws and second disk 398 is coupled to elongate element 391 of second end portion 372*b* by first and second clamps 401 and 402 which serve as clamping means. Clamps 402 and 403 are each welded or otherwise suitably joined to second disk 398 and have straps 406 which encircle tubular second end portion 372*b* for securing second disk 398 thereto.

Clamps 402 and 403 each slidably engage elongate element 391 of upper arm section 372 to permit pivot and rotation of board 348 about central longitudinal axis 390 as illustrated in FIG. 10. Fastener 407, which threadedly engages strap 406 on second clamp 403 and has a head portion 407*a* and an end portion 407*b*, and radial bore 408, which is substantially perpendicular to axis 390, provided in elongate element 391 of upper arm section 372 act as means for pivotally locking tables 346 and 347 about arm 368. When end portion 407*b* is engaged with bore 408 in upper arm section 372, axis 401 of swivel 396 is substantially vertical with respect to upper surface 68 and the related table pivots in a substantially horizontal plane. Rotation of head portion 407*a* in a first direction causes end portion 407*b* to cooperatively mate with and lock within aligned bore 408, while rotation of head portion 407*a* in a second direction causes end portion 407*b* to be removed and unlocked from bore 408. Although only one bore, bore 408, has been shown in elongate element 391, a plurality of radial bores at different angles with respect to the horizontal could be provided therein or other means provided to permit rotation and locking of tables 346 and 347 with respect to arm 368 and be within the scope of the present invention. In addition, fastener 47 could be a spring loaded pin, as known to those skilled in the art, and be within the scope of the present invention.

Lower and upper arm sections 371 and 372 of each arm assembly 366 and 367 pivot in substantially parallel horizontal planes, and first and second tables 346 and 347 can also pivot in a substantially horizontal plane. In this regard, axes 78 and 381 are substantially vertical with respect to upper surface 68 and are substantially parallel to each other, and axis 401 can also be so vertically aligned and parallel to axes 78 and 391. Central longitudinal axis 390 is substantially perpendicular to axes 78, 381 and 401.

Each of first and second tables 346 and 347 has a block such as retaining bar 415 mounted in an elongate slot 416 in first side portion 348*a* of board 348 for supporting or positioning objects on the table, particularly when the table is inclined with respect to the horizontal (See FIG. 1 and FIGS. 11 through 14). Slot 416 is substantially rectangular in plan and is formed from first and second facing and parallel inner sides 417 and 418 in board 348 which are substantially parallel to first and second sides 353 and 356 thereof, and rounded inner ends which adjoin inner sides 417 and 418. Each retaining bar 415 is formed of a suitable material such as plexiglass and is substantially in the form of a parallelepiped with top and bottom surfaces 419 and 420, front and back surfaces 421 and 422, and first and second ends 423 and 426. Retaining bar 415 has a protruding lip 427 on front surface 421 which assists in shaping head portion 415*a*.

Figure 13:
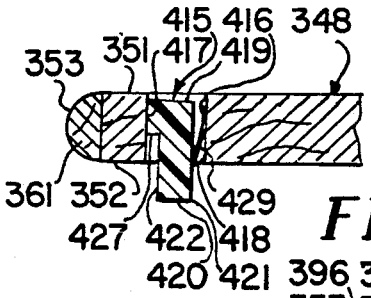
FIG. 13 is a cross-sectional view similar to FIG. 12 of the convertible furniture assembly according to the invention.
Figure 12:
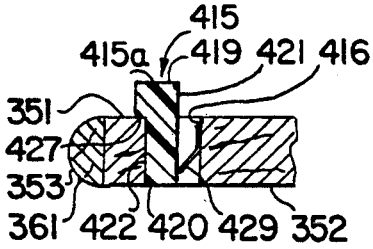
FIG. 12 is a cross-sectional view looking along the line 12—12 of FIG. 11.

Retaining bar 415 is movable from a first position where retaining bar 415 does not protrude from top surface 351 of board 348, as illustrated in FIG. 13, to a second position where retaining bar 415 does protrude from surface 351, as illustrated in FIG. 12. Slot 416 has a spring 429 fastened to second inner side 418 of board 348 opposite front surface 421 of retaining bar 415 which engages front surface 421 and urges back surface 422 of the retaining bar against first inner side 417 of board 348 causing the retaining bar to remain in the desired position with respect to board 348. When retaining bar 415 is in its second position illustrated in FIG. 12, lip 427 abuts top surface 351 and prevents the retaining bar from moving downwardly within slot 416. Spring 429 serves as means for retaining bar 415 in its first position and, together with lip 427, also serve as means for locking retaining bar 415 in its second position.

Retaining bar 415 is moved from its first position to its second position by pushing upwardly on bottom surface 420 thereof which protrudes from bottom surface 352 of board 348 when the retaining block is in its first position. The retaining bar is returned to its first position by simultaneously pushing back surface 422 of retaining bar 415 against spring 429 and top surface 419 downwardly with respect to top surface 351 of board 348.

Figure 16:
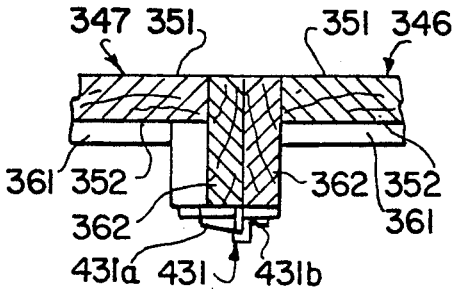
FIG. 16 is a cross-sectional view looking along the line 16—16 of FIG. 15.
Figure 15:
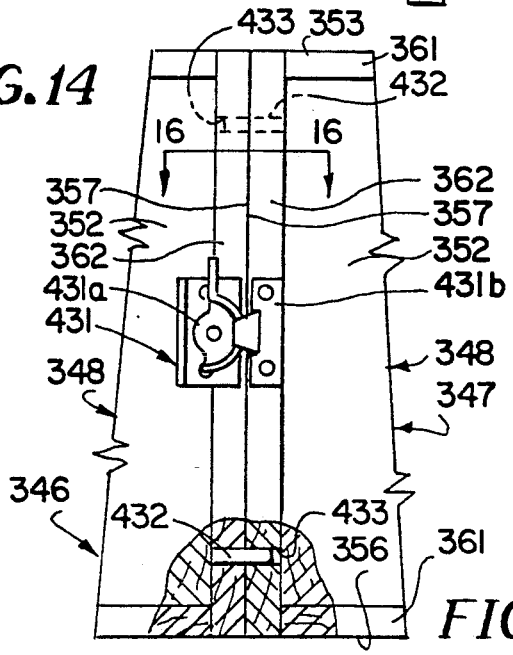
FIG. 15 is a bottom plan view looking along the line 15—15 of FIG. 14.

First and second tables 346 and 347 can be joined and have means for coupling the tables together which includes latch 431 with a first clasp portion 431*a* fastened on bottom surface 352 of first table 346 and a second hook portion 431*b* fastened on bottom surface 352 of second table 347 (See FIGS. 14 through 16). The means for coupling the tables together also include means for aligning top surfaces 351 thereof so that they are substantially coplanar with each other when coupled together and for positioning first and second sides 353 and 356 thereof so that they are substantially aligned. Dowels 432 snugly disposed in bores on trim 362 on first ends 357 of boards 348 and opposing aligned bores 433 also provided in trim 36 and which cooperatively mate with dowels 432 serve as these aligning and positioning means, as illustrated in FIG. 15.

In another embodiment of tables 346 and 347, illustrated in FIG. 3 with respect to first table 346, first and second hooks 436 and 437 are fastened to second end 358 in a suitable manner such as screws and serve to cradle first hand unit 240 alongside table 346. When so mounted on board 348 of table 346, first surface 243 of hand unit 240 is substantially parallel with top surface 351 of board 348 with first and second switches 247 and 248, as well as safety switch 249, on the hand unit readily accessible to the human.

Accessory Modules

Convertible furniture assembly 40 is provided with dining modules in the form of serving and eating trays for converting the assembly into a dining or eating arrangement. A serving and eating tray such as appetizer or hors d'oeuvres tray 455 can be mounted on board 348 of either or both of first and second tables 346 and 347 and be removed therefrom for use on an elevated surface such as counter 456 shown in dashed lines in FIG. 25. Tray 455 is substantially rectangular in plan, with length and width dimensions approximating those of board 348, and can be made of a suitable material such as plexiglass. The tray has a central section 457 with first and second opposite planar surfaces 458 and 461 and first and second opposite sides 462 and 463 (See FIGS. 24 and 25). First and second opposite side sections 466 and 467 consisting of planar strips made from a suitable material such as plexiglass and having a length approximately equal to the length of central section 457 are joined at substantially right angles to sides 462 and 463. side sections 466 and 467 have first substantially aligned portions 466*a* and 467*a* and second substantially aligned portions 466*b* and 467*b* which extend substantially equidistant beyond first and second surfaces 458 and 461, respectively. Side portions 466*a* and 467*a* and side portions 466*b* and 467*b* each cooperatively extend past sides 353 and 356 of tables 346 and 347 to secure tray 455 thereon, and also serve as legs for supporting tray 455 on counter 456.

Figure 22:
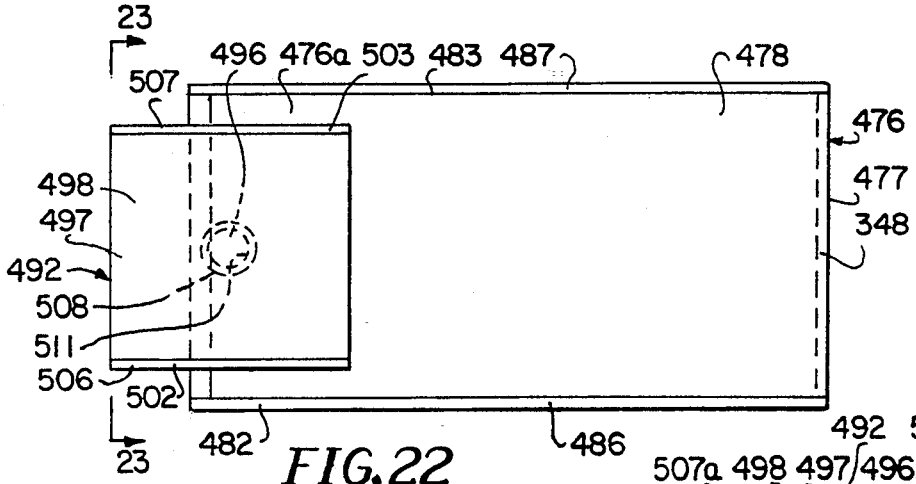
FIG. 22 is a top plan view of another embodiment of a portion of the convertible furniture assembly according to the invention.
Figure 24:
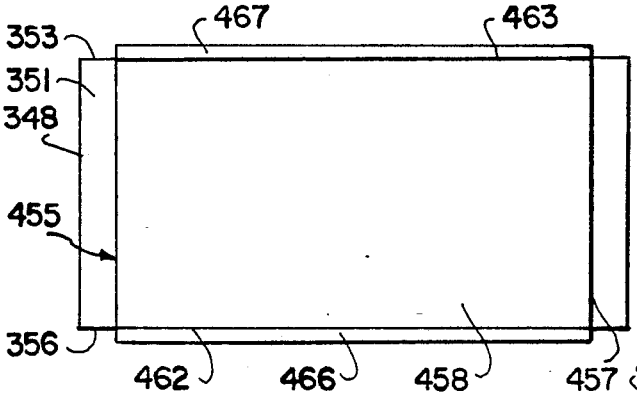
FIG. 24 is a top plan view of another embodiment of a portion of the convertible furniture assembly according to the invention.
Figure 23:
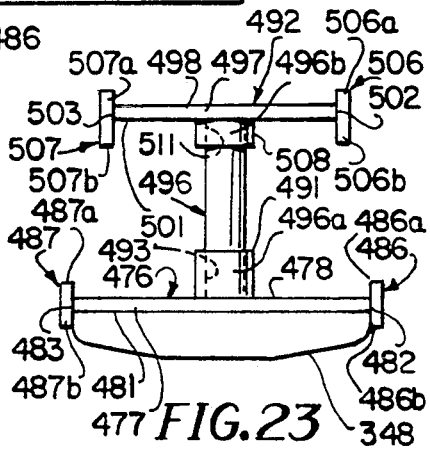
FIG. 23 is a side elevational view looking along the line 23—23 of FIG. 22.
Figure 25:
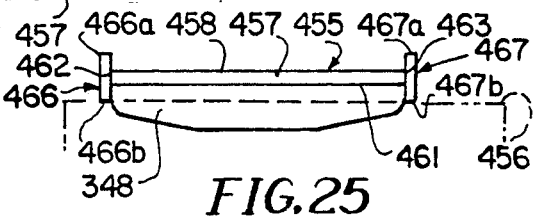
FIG. 25 is a side elevational view looking along the line 25—25 of FIG. 24.

A serving and eating tray such as dinner tray 476 with an end portion 476*a* can also be mounted on either or both of first and second tables 346 and 347 and be removed therefrom for use on counter 456 (See FIGS. 22 and 23). Dinner tray 476 is substantially similar to hors d'oeuvres tray 455 in conformation, dimensions and material, and has a central section 477 with first or top and second or bottom opposite planar surfaces 478 and 481, and first and second opposite sides 482 and 483 with first and second opposite side sections 486 and 487 joined thereto. Side sections 486 and 487 have first substantially aligned portions 486*a* and 487*a* and second substantially aligned portions 486*b* and 487*b*. Portions 486*b* and 487*b* serve to secure dinner tray 476 to tables 346 and 347 and serve as legs in the same manner as portions 466*b* and 467*b* of hors d'oeuvres tray 455.

Dinner tray 476 includes a disk 491 made of a suitable material such a plexiglass and fastened to top surface 478 on end portion 476*a* by a suitable means such as glue for mounting a supplemental tray, such as dessert tray 492, in an elevated position above the dinner tray. Disk 491 is provided with a central bore 493. A cylindrical post 496 is mounted to dinner tray 476 in a substantially vertical and upright position and has a first end portion 496*a* disposed in bore 493 and carried by disk 491 and a second end portion 496*b*. Post 496 can be made of any suitable material such as metal.

Dessert tray 492 is smaller but otherwise substantially similar to tray 455 in conformation and material, and has a central section 497 with first or top and second or bottom opposite planar surfaces 498 and 501, and first and second opposite sides 502 and 503 with first and second opposite side sections 506 and 507 joined thereto. Side sections 506 and 507 have first substantially aligned portions 506*a* and 507*a* and second substantially aligned portions 506*b* and 507*b*. Bottom surface 501 has a disk 508 substantially similar to disk 491 fastened to the center thereof by a suitable means such as glue. Disk 508, together with post 496, acts as means for removably mounting dessert tray 492 in an elevated position above dinner tray 476 and is provided with a central bore 511 for receiving second end portion 496*b* of post 496. Portions 506*b* and 507*b* extend below bottom surface 501 a distance greater than disk 508 so that portions 506*b* and 507*b* can serve as legs for supporting dessert tray 492 on a surface when the dessert tray is not mounted to dinner tray 476.

Figure 17:
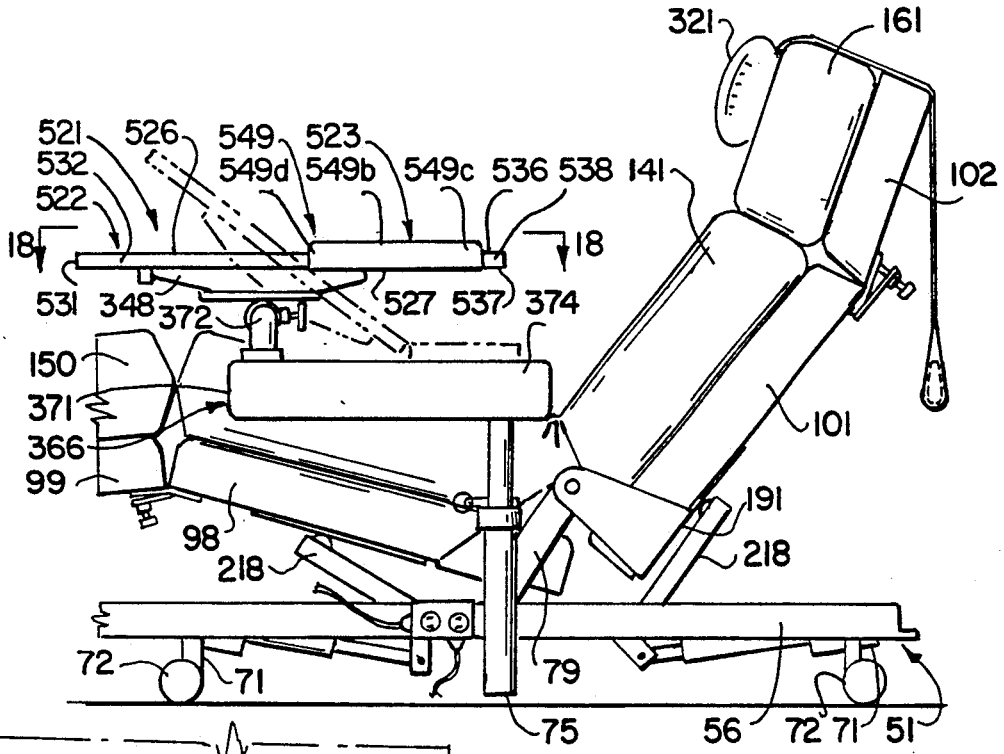
FIG. 17 is a side elevational view of another embodiment of a portion of the convertible furniture assembly according to the invention.
Figure 18:
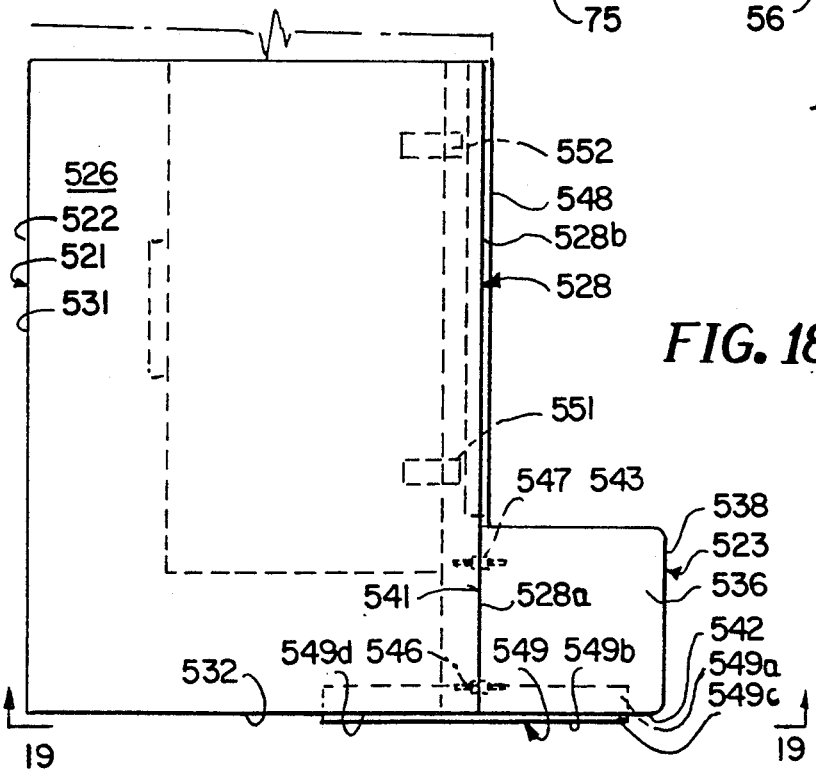
FIG. 18 is a top plan view looking along the line 18—18 of FIG. 17.
Figure 19:
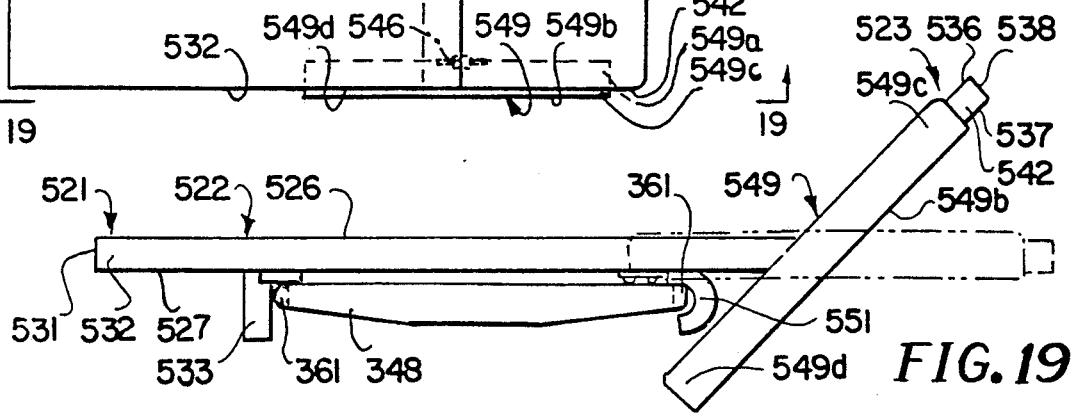
FIG. 19 is a side elevational view looking along the line 19—19 of FIG. 18.
Figure 20:
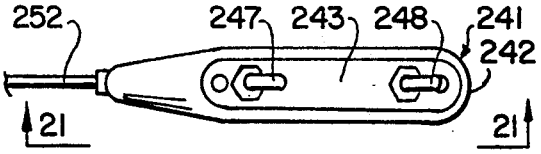
FIG. 20 is an enlarged view looking along the line 20—20 of FIG. 1.
Figure 21:
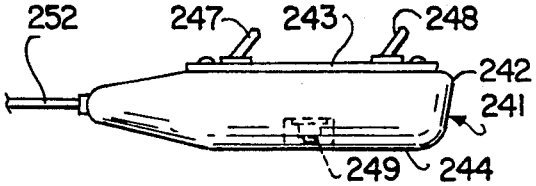
FIG. 21 is a side elevational view looking along the line 21—21 of FIG. 20.

A working module such as a worktable can be removably mounted on board 348 of either or both of first and second tables 346 and 347 in place of trays 455 and 476 for significantly expanding the surface area useable by the humans thereon and converting furniture assembly 40 into a desk (See FIGS. 17 through 19). The worktable for first table 346 can consist of worktable 521, which is made of any suitable material such as wood. Worktable 521 has a central portion or desk top 522 with a substantial surface area and an arm portion or armrest 523. Desk top 522 provides a substantial work surface for the human and is rectangular in plan with top and bottom surfaces 526 and 527, first and second opposite sides 528 and 531 and first and second opposite ends 532 and 533. First side 528 includes a first side portion 528*a* which adjoins first end 532 and a second side portion 528*b* which adjoins second end 533. Armrest 523 can be used for resting a left arm or elbow and for positioning objects away from the central work space. The armrest is also rectangular in plan, but significantly smaller than desk top 522, and has top and bottom surfaces 536 and 537, first and second opposite sides 538 and 541 and first and second opposite ends 542 and 543.

First and second hinges 546 and 547 serve as means for pivotally connecting armrest 523 to desk top 522, with second side 541 of armrest 523 abutting first side portion 528*a* of desk top 522. Hinges 546 and 547 are not visible on top surfaces 526 and 536 and each have one leaf portion embeddedly fastened in first side portion 528*a* adjacent bottom surface 527 and a second leaf portion embeddedly fastened in second side 541 adjacent bottom surface 537. The hinges permit first side 538 of armrest 523 to pivot upwardly with respect to desk top 522 as shown in FIG. 19.

Second side portion 528*b* has a retainer bar 548 consisting of an elongate metal strip fastened thereto by a suitable means such as screws not shown in the drawings. A portion of retainer bar 548 protrudes above surface 526 for retaining or positioning objects on desk top 522 of worktable 521, particularly when table 346 is pivoted with clamps 402 and 403 so that top surface 526 is inclined with respect to the horizontal.

Worktable 521 includes means for retaining armrest 523 in a home position coplanar with desk top 522, as illustrated in FIG. 17, consisting of an elongate stop bar 549. The bar has first and second planar portions 549*a* and 549*b* joined at a right angle to each other and extending the length of the bar, and first and second end portions 549*c* and 549*d*. First end portion 549*c* is fastened to the corner of armrest 523 formed by bottom surface 537 and first end 542 by a suitable means such as screws not shown in the drawings, with first planar portion 549*a* abutting bottom surface 537 and second planar portion 549*b* abutting end 542. Second end portion 549*d* extends from armrest 523 in the plane thereof and engages desk top 522, with first planar portion 549*a* thereof abutting bottom surface 527 of desk top 522, when desk top and armrest 522 and 523 are coplanar. A part of second planar portion 549*b* extends above top surfaces 526 and 536 and thereby serves as means for retaining objects on worktable 521.

Means for mounting worktable 521 to board 348 is carried on bottom surface 527 of desk top 522 and includes first and second spaced apart hooks 551 and 552 fastened near and substantially equidistant from first side 528 by a suitable means such as screws not shown in the drawings and elongate attachment block 553 fastened substantially parallel to second side 531 and equidistant from hooks 551 and 552 by a suitable means such as screws not shown in the drawings. The hooks have an arcuate contour similar to rounded first side 353 of board 348 for receiving board 348 while rounded second side 356 of board 348 permits attachment block 553 to urge first side 353 into hooks 551 and 552 as worktable 521 is pushed down onto table 346. Worktable 521 is mounted to first table 346 so that second end 533 of the worktable is substantially coplanar with first end 357 of board 348 and does not protrude over second table 347 when tables 346 and 347 are coupled together as discussed above.

When worktable 521 is so mounted on first table 346, pivoting of the table and worktable about axis 390 with respect to upper arm section 372 causes armrest 523 to engage top surface 374 of lower arm section 371 and pivot with respect to desk top 522 to a substantially horizontal position (Shown in dashed lines in FIG. 17). As positioned, top surface 526 of desk top 522 is inclined at an angle with respect to the human and the horizontal and bottom surface 537 of armrest 523 abuts top surface 374. Armrest 523 can be used in this position by a human seated on convertible furniture assembly 40 for resting his or her arm or other objects thereon. If arm 368 is manufactured so that upper arm section 372 can be adjusted in height with respect to lower arm section 371, the angle of inclination of desk top 522 with respect to the horizontal can be adjusted by varying the height of the upper arm section with respect to the lower arm section.

A worktable similar to worktable 521 is also provided for second table 347. This worktable is substantially identical to worktable 521 except that armrest 523 is connected to the opposite side of desk top 522 so that it can be used by the right arm of a human and it cooperates with second arm assembly 367. The worktable for second table 347 is mounted on the table in the same manner as worktable 521 is mounted to first table 346 and, when tables 346 and 347 are joined together, the worktables substantially abut and align with each other and the top surfaces of the desk tops form one large substantially coplanar surface.

Figure 27:
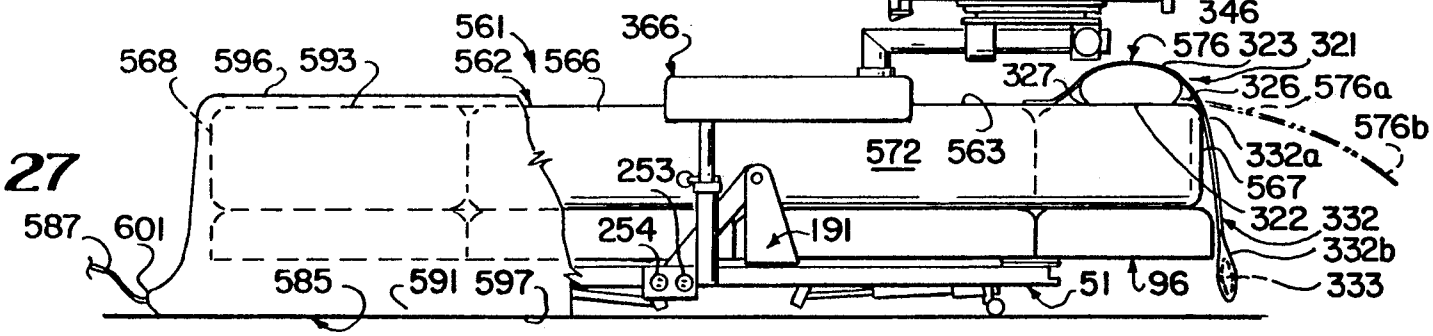
FIG. 27 is a side elevational view looking along the line 27—27 of FIG. 26.
Figure 28:
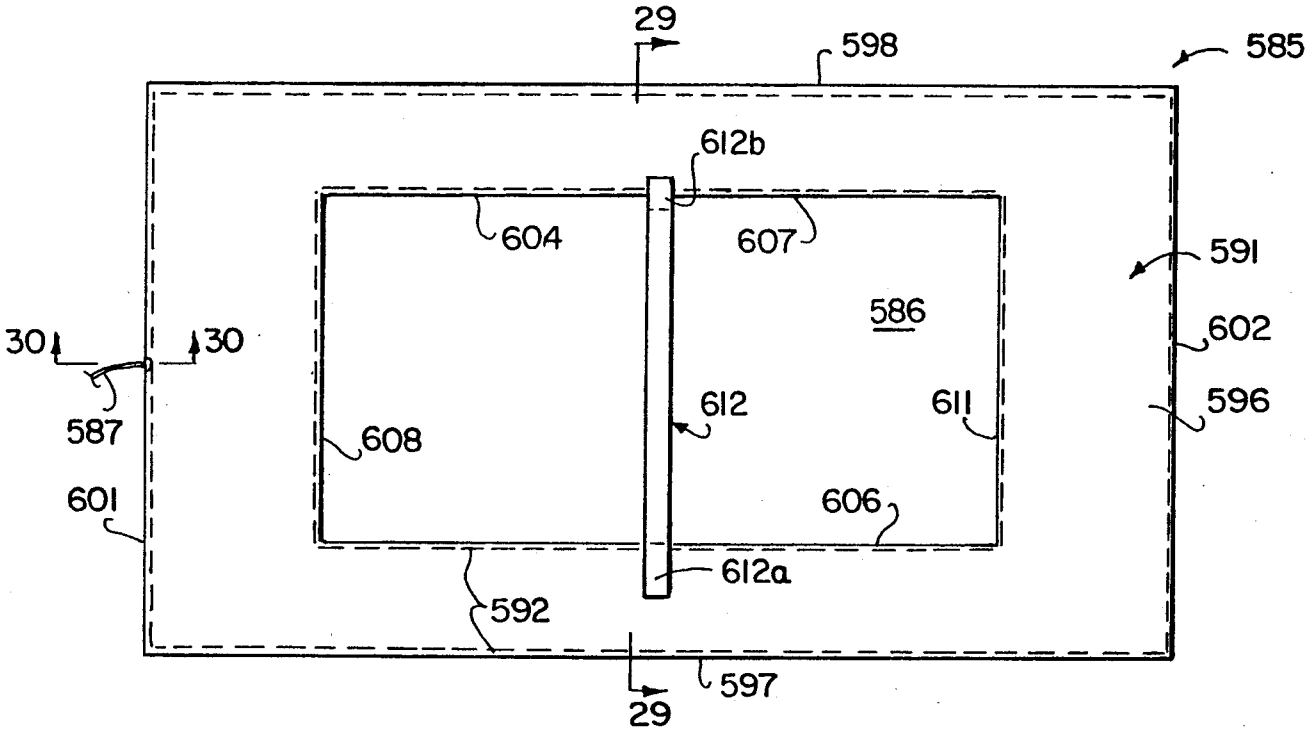
FIG. 28 is a top plan view of a portion of another embodiment of the convertible furniture assembly according to the invention.
Figure 29:
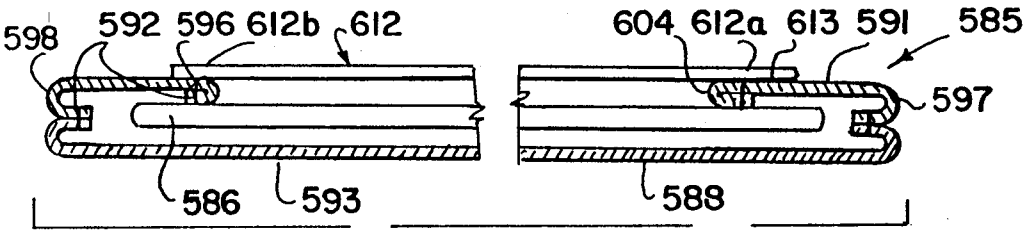
FIG. 29 is a cross-sectional view looking along the line 29—29 of FIG. 28.
Figure 30:
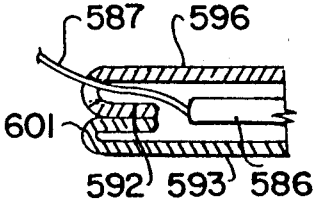
FIG. 30 is a cross-sectional view of looking along the line 30—30 of FIG. 28.

Convertible furniture assembly 40 is provided with several sleeping modules which include a sheet 561 made of any suitable material such as cotton or silk and fitted to cover central cushion 141, foot cushion 150 and head cushion 161 (See FIGS. 26 and 27). Sheet 561 has a first or outer surface 562 on which the humans can recline and a second or inner surface 563 which abuts the cushions. Outer surface 562 is comprised of a top section 566 with a head portion 566*a*, first and second end sections 567 and 568, and first and second side sections 571 and 572.

Two pillows 321 can b disposed on head portion 566*a* of sheet 561 over first and second parts 162 and 163 of head cushion 161. For each pillow 321, strip 332 with weight 333 therein extends over and frictionally engages sheet 561 and serves as a counterbalance to the pillow so that the pillow is retained in a position to which it is moved.

Sheet 561 includes a substantially rectangular flap 576 having first and second end portions 576*a* and 576*b* for covering and folding over pillows 321. First end portion 576*a* is joined to first end section 567 and is provided with first and second spaced apart elongate slits or holes 577 and 578 which are each sized to permit strip 332 with weight 333 therein to extend therethrough and thereby hang across first end section 567 and off convertible furniture assembly 40.

Another sleeping module provided with convertible furniture assembly 40 is slipcover 585, which is made of a suitable material such as cotton or silk and is adapted to enclose a bed covering such as electric blanket 586 with an electrical cord 587 when the convertible furniture assembly is used as a bed by the two humans. Slipcover 585 is substantially rectangular in plan and has first and second sections 588 and 591 which are joined together along the borders thereof by a suitable means such as stitching 592. Electric blanket 586 is sandwiched between first and second sections 588 and 591. Slipcover 585 has first and second outer surfaces 593 and 596 which consist of the outer surfaces of first and second sections 588 and 591, respectively. When the slipcover is draped over convertible furniture assembly 40 as shown in FIGS. 26 and 27, surface 593 abuts outer surface 562 of sheet 561 and second surface 596 faces upwardly. Slipcover 585 also has first and second outer sides 597 and 598 and first and second outer ends 601 and 602 which form perimeter 603 thereof.

Slipcover 585 is provided with a rectangular opening 604 substantially in the center of second section 591 to permit electric blanket 586 to be inserted and removed from the slipcover. Opening 604 is of significant size to permit viewing of electric blanket 586 when it is inserted in slipcovering 585, and is formed by first and second inner sides 606 and 607 and first and second inner ends 608 and 611. Inner sides 606 and 607 are substantially parallel to outer sides 597 and 598 and inner ends 608 and 611 are substantially parallel to outer ends 601 and 602.

Second section 591 has a strap 612 having first and second end portions 612*a* and 612*b* across opening 604 for adding support to slipcover 585. Among other things, strap 612 holds the opposite sides of second section 591 in proper spacial relationship and assists in retaining electric blanket 586 within slipcover 585 during its use on convertible furniture assembly 40. Strap 612 is substantially parallel to ends 601 and 602 and extends from approximately the middle of second inner side 607 to first inner side 606. Second end portion 612*b* is joined to second section 591 adjacent side 607 by a suitable means such as to second section 591 adjacent side 606 by a suitable means such as velcro tabs 613.

Perimeter 603 is provided with a hole 616 substantially in the center of first outer end 601 to permit access to electric blanket 586. Hole 616 is positioned and designed so that electrical cord 587 can extend from electric blanket 586 through hole 616 and access an electrical outlet such as electrical receptacle 254 in junction box 253.

Operation and Use

In operation and use, convertible furniture assembly 40 can serve as an integral piece of furniture for a home and can be used by two humans for reclining, sleeping and numerous other purposes. The pivot point interconnecting lower and upper wings 42 and 43 and the pivot points with the lower and upper wings generally correspond to the joints in a human body. First and second hinge assemblies 191 and 192 correspond to the human hip. First and second hinge assemblies 266 and 267 interconnecting seat section 82 and leg and foot section 91 generally correspond to the human knee, while first and second hinge assemblies 301 and 302 interconnecting back section 83 and head section 88 generally correspond to the human neck.

First and second hinge assemblies 191 and 192 generally determine the angle of the lower and upper wings 42 and 43 with respect to each other. The ability of distal end portions 82*b* and 83*b* to be raised and lowered independent of each other provides the humans with significant flexibility in configuring the furniture assembly for use together. The relatively unrestrained movement of each wing 42 and 43 about the pivot formed by hinge assemblies 191 and 192 also facilitates ease of access to the underside of the wings for cleaning, assembly, maintenance or other purposes.

Hinge assemblies 266 and 267 for seat section 82 and hinge assemblies 301 and 302 for back section 83 allow adjustment of the respective wings to determine the shape thereof and a different contour of each wing 42 and 43 for the two humans. The ability of first and second parts 89 and 90 of head section 88 and first and second parts 92 and 93 of leg and foot section 91 to be raised and lowered independent of each other permits custom angle adjustment by each human of his or her portion of the furniture assembly to meet his or her needs.

Movable first and second hand units 240 and 241 with respective cables 252 attached thereto allow the humans to raise and lower seat and back sections 82 and 83 from positions remote from convertible furniture assembly 40. Cables 252 also permit placement of hand units 240 and 241 in positions on and about the convertible furniture assembly. For example, a hand unit can be placed in a first position on a table 346 or 347 and in a second position away from convertible furniture assembly 40, such as on support surface 41, each as illustrated in FIGS. 1 and 2 where first hand unit 240 is on support surface 41 and second hand unit 241 is on second table 347.

Seat and back sections 82 and 83 can be lowered to a coplanar and substantially horizontal position resting on framework 51 for converting assembly 40 to a bed (See FIGS. 26 and 27). When in this position, sections 82 and 83 form at least part of the bed, and cushions 141, 150 and 161 disposed on segmented foundation 96 provide a generally horizontal surface on which the humans can lie.

Convertible furniture assembly 40 has several modules for use therewith when so configured as a bed, including sheet 561 and pillows 321. Flap 576 serves as a pillow cover for pillows 321 and holes 577 and 578 therein permit strips 332 with weights 333 therein to extend through the flap and serve as a counterbalances for retaining the pillows in the positions comfortable for use by the two humans. Since width and length dimensions 184 and 185 approximate those of a standard twin bed, conventional bedding can also be used with convertible furniture assembly 40.

Slipcover 591 protects blankets or comforters, such as electric blanket 586, from being soiled by the humans when used with convertible furniture assembly 40. Opening 604 in the center of second section 591 of slipcover 585 permits placement and removal of electric blanket 586 within the slipcover. The opening also has the unique function of permitting electric blanket 586 to be viewed when within the slipcover, allowing the visual aesthetics of the convertible furniture assembly to be easily altered by merely changing the color or appearance of the electric blanket or other bed covering contained in slipcover 591.

First and second arms assemblies 366 and 367 permit tables 346 and 347 to be moved to positions alongside first and second parts 89 and 90 of head section 88, and not overlying seat section 82, to act as nightstands easily accessible by the humans resting on convertible furniture assembly 40. Arm assemblies 366 and 367 are each provided with a four pivot design, with 360 degree rotation permitted around each of vertical axes 78, 381 and 401 and rotation permitted around horizontal axis 390. Hand units 240 and 241 and other objects such as alarm clocks and lamps can be placed on tables 346 and 347. Electrical receptacle 254 in junction box 253 is centrally positioned on framework 51 to provide electrical current for powering these devices.

First and second arm assemblies 366 and 367 are designed such that upper arm section 372 and the related table 346 or 347 can be easily removed from lower arm section 371 to permit lower arm section 371 to be used independently as an armrest by the human. Since upper arm section 372 is not fastened to lower arm section 371, it can be separated therefrom by simply lifting second end part 392*b* from within receptacle 380. Covering 376 on frame element 373 provides lower arm section 371 with an appearance suitable for a finished end piece.

Convertible furniture assembly 40 can also be used as a lounge by the two humans. For this use, seat and back sections 82 and 83 are moved from their coplanar position to positions at which they are disposed at an angle with respect to each other to form at least part of a lounge (See FIG. 3). The three vertical pivot design of first and second arm assemblies 211 and 212 allow tables 346 and 347 to be readily moved out of the way when the humans are getting on or off convertible furniture assembly 40. Once the humans are seated or reclining on the convertible furniture assembly, tables 346 and 347 can be configured and adjusted, separately or together, to various positions for meeting the needs and dimensions of the humans. Among other things, each of the tables can be separately adjusted to a desired height above support surface 41, by disposing removable metal pin 387 in the appropriate bore 378 in tube 377, and inclined from the horizontal, by slidably rotating first and second clamps 402 and 403 about upper arm section 372. Retaining bar 415 can be easily moved from its first position where top surface 419 thereof is substantially flush with top surface 351 of board 348 and snapped into its second position where head portion 415*a* protrudes above top surface 351 for positioning and securing books or other objects on tables 346 and 347 when they are in an inclined position.

Convertible furniture assembly 40 includes several other modules for use with tables 346 and 347. Hors d'oeuvre tray 455 and dinner tray 476 can be used as serving trays and eating surfaces when the assembly is used as a dining or eating arrangement. Each of the trays are provided with side sections which act as legs and means for supporting the trays on a counter or buffet when preparing the food and as means for mounting and securing them on tables 346 and 347. The plexiglass construction of the trays provides for an elegant and transparent serving piece which is also durable, and allows the table to retain its uncluttered and natural appearance when the trays are used as eating surfaces. The symmetrical design of hors d'oeuvre tray 455 permits it to be used with either first surface 458 or second surface 461 facing upwardly and serves to prolong the effective life thereof. The means for removably mounting dessert tray 492 on dinner tray 476 efficiently expands the dining surface area, and does so in a tasteful manner.

Worktables such as worktable 521 provide a significantly expanded work area when convertible furniture assembly 40 is used as a desk. Sufficient space is provided to permit the use of computers and other office equipment with the furniture assembly, with nearby electrical current available at junction box 253. The ability of tables 346 and 347 to incline about upper arm section 372 permits worktable 521 to be converted into a drafting or drawing board, with retainer bar 548 serving to retain work papers and materials on worktable 521. Worktables 521 are easily mounted on and removed from tables 346 and 347 without the use of tools.

Convertible furniture assembly 40 is designed with several features for extending the life thereof. Central cushions 141 and 178 are reversible so that either one of first and second surfaces 146 and 147 or 179 and 180, respectively, can face upwardly. In addition, central cushions 141 and 178 are designed so that first or second portions 141*a* and 141*b* be disposed on either seat or back sections 82 and 83. These features prolong the useful life of the cushion by permitting wear to be distributed between the two surfaces of the central cushion and by permitting the greater wear traditionally experienced by the seat section to be distributed between first and second portions 141*a* and 141*b* of each opposite surface 146 and 147. In addition, covering 173 is zipped in place to permit ease of removal thereof if any of central cushions 141 and 178, foot cushion 150 or head cushion 161 are in need of cleaning or replacement. Covering 331 from pillows 321 can also be removed if the pillow is in need of cleaning.

The ability of padding 172 in cushions 141, 178, 150 and 161 and padding 328 in pillows 321 to be removed also permits it substitution by padding of other densities if cushions or pillows with other feels are desired by the humans using convertible furniture assembly 40.

The design of convertible furniture assembly 40 also permits its appearance to be easily changed to fit the occasion or decorum. Covering 173 on opposite surfaces 146 and 147 or 179 and 180 of central cushions 141 and 178 can be made from different materials or have a different conformation or design, permitting one to easily and inexpensively change the appearance of convertible furniture assembly 40 and/or the feeling experienced by sitting or reclining thereon by simply reversing the cushion. In addition, alternate foot and head cushions 150 and 161, or coverings 173 therefor, can be obtained for changing the appearance of those cushions as well.

Central cushions 141 and 178 are also designed to be easily removed to permit their use as floor cushions or with other furniture pieces of the same family designed to accommodate them. Alternatively, the central cushions can be interchanged with the cushions on these other furniture pieces if one desires.

Convertible furniture assembly 40 is designed to facilitate ease of shipping and can be efficiently packaged in a relatively flat container. Seat and back sections 82 and 83 can be easily shipped when mounted on framework 51. In addition, however, the convertible furniture assembly has been designed to minimize attachment points between framework 51 and sections 82 and 83. As a result, sections 82 and 83 can be quickly separated from framework 51 for shipping by removing one bolt and nut, bolt 197 and nut 198, from each of first and second hinge assemblies 191 and 192. Lifters 218 are not fastened to sections 82 and 83, which simplifies the removal of sections 82 and 83 from framework 51. First and second arm assemblies 366 and 367 can also be easily disassembled for shipping. To do so, elongate element 391 of upper arm section 372 is slidably disengaged from clamps 402 and 403, tube 392 of the upper arm section is removed from receptacle 380 in lower arm section 371, and tube 377 of the lower arm section is removed from arm socket 75 on framework 51, all without the use of tools.

Convertible furniture assembly 40 can be easily further disassembled into its various elements and components. In the event that repairs are needed, the damaged element or component can readily removed by the owner for repair or for replacement with a new element or component shipped from the manufacturer.

Single Person Multipurpose Convertible Furniture Assembly

Convertible furniture assembly 40 can also be sized and manufactured for use by one human. A single human convertible furniture assembly 40 is substantially similar to the furniture assembly shown in the drawings, except that most desirably head section 88 and leg and foot section 91 are each formed in one part. Accordingly distal portions 99*b* and 102*b* of the lower and upper wing foundation sections 97 and 100, and foot and head cushions 150 and 161, are also each formed in one part. Width dimension 184 for a single human furniture assembly is approximately 30 inches, although other dimensions are also within the scope of the present invention.

Another difference between a single human convertible furniture assembly 40 sized for two humans and an assembly sized for one human is the elimination of one pillow 321 and sizing of the remaining pillow 321 to approximate the size of single part head section 88. In addition, one of first and second hand units 240 and 241 and one of first and second tables 346 and 347 would be eliminated. Since tables 346 and 347 and related arm assemblies 366 and 367 are substantially similar in design and construction, the remaining table and arm assembly could be removably mounted in an arm socket 75 on either side of framework 51, but movable to the arm socket on the other side of framework 51 if the human so desires.

It is apparent from the foregoing that a new and improved convertible work assembly has been provided which can accommodate one or two humans and has back and seat support sections which are adjustable independent of each other. The assembly is convertible between a lounge and a bed, and includes modules such as a sheet and a slipcover for use when the assembly is converted to a bed. The assembly also includes an adjustable table for use therewith, and modules such as serving trays and worktables for use with the table and for converting the assembly to a dining arrangement and a desk, respectively. While only certain presently preferred embodiments have been described in detail, as will be apparent to those familiar with the art, certain changes and modifications can be made without departing from the scope of the invention as defined by the following claims.

What is claimed is:

1. A furniture assembly for use on a support surface by a human comprising a framework adapted to rest upon the support surface, seat and back support sections overlying the framework and having adjacent proximal and spaced-apart distal end portions, an elongated cushion disposed simultaneously on both the support sections and having a thickness, hinge means supported by the framework forming a pivot axis interconnecting the adjacent end portions of said seat and back support sections, said pivot axis being disposed above the framework and said support sections such that it extends transversely through the cushion in a position which is within the thickness of the cushion at all times so as to be generally aligned with the hip joint of the human, and means mounted on the framework for raising and lowering the distal end portions of the seat and back support sections independent of each other about the pivot axis of the hinge means.

2. The furniture assembly of claim 1 together with a head support section for supporting the head of the human and means for pivotally connecting the distal end portion of the back support section to the head support section.

3. The furniture assembly of claim 2 wherein the means for pivotally connecting the back support section to the head support section includes means for adjusting the angular position of the head support section with respect to the back support section.

4. The furniture assembly of claim 2 wherein said furniture assembly is for use by two humans and wherein said head support section is formed in two separately movable parts, one part for each head of the two humans.

5. The furniture assembly of claim 1 together with a head support section carried by the back support section, a head rest movably disposed on the head support section and weight means connected to the head rest and extending and hanging over the head support section so as to serve as a counterbalance to the head rest, the weight means frictionally engaging the head support section so as to retain the head rest in a position to which it is moved.

6. The furniture assembly of claim 1 together with a calf support section for supporting the calves of the human and means for pivotally connecting the distal end portion of the seat support section to the calf support section.

7. The furniture assembly of claim 6 wherein the means for pivotally connecting the seat support section to the calf support section includes means for adjusting the angular position of the calf support section with respect to the seat support section.

8. The furniture assembly of claim 6 wherein means is provided by the framework for retaining the calf support section in a position coplanar with the seat support section when the seat support section is lowered to a horizontal position.

9. The furniture assembly of claim 6 wherein said furniture assembly is for use by two humans and wherein said calf support section is formed in two separately movable parts, one part provided for each of the calves of one human.

10. The furniture assembly of claim 1 together with means for controlling the raising and lowering of the distal end portions of the seat and back support sections which is accessible to the human when the human is being supported by the seat and back support sections.

11. The furniture assembly of claim 10 together with a table and means for mounting the table to the framework so that it is movable between a first position overlying the first section and a second out-of-the-way position not overlying the first section, the control means including cable means to permit placement of the control means in a first position on the movable table and in a second position away from the furniture assembly.

12. The furniture assembly of claim 10 wherein the control means includes a first switch for raising and lowering the distal end portion of the seat support section, a second switch for raising and lowering the distal end portion of the back support section, and a safety switch which must be engaged to permit lowering of either support section.

13. The furniture assembly of claim 1 together with an armrest mounted on each side of the framework for use by the human.

14. The furniture assembly of claim 13 wherein said armrests are pivotally mounted to the framework.

15. The furniture assembly of claim 1 wherein the seat and back support sections each have first and second opposite sides and wherein the hinge means includes first and second hinge assemblies disposed on the opposite sides of the seat and back support sections.

16. The furniture assembly of claim 15 wherein each hinge assembly includes a single removable interconnecting member.

17. The furniture assembly of claim 15 wherein the pivot axis is disposed in line with an imaginary line extending transversely through the cushion in a position which is generally at the midpoint of the thickness of the cushion.

18. The furniture assembly of claim 1 wherein the hinge means interconnecting the proximal end portions of the seat and back support sections includes a hinge assembly which interconnects the support sections and the framework at the pivot of the hinge means with a single interconnecting member.

19. The furniture assembly of claim 1 wherein the means mounted on the framework for independently raising and lowering the distal end portions of the seat and back support sections includes an arm for each of the support sections with a proximal end pivotally coupled to the framework and a distal end slidably engaging the respective support section and motive means for causing pivotal movement of the arm to cause pivotal movement of the respective support section.

20. The furniture assembly of claim 19 wherein said motive means includes an electric motor and remote control means for operating the motor.

21. The furniture assembly of claim 19 wherein the framework is generally rectangular in plan and includes for each support section an elongate cross member rotatably mounted to the framework and having two aligned arms joined thereto in spaced apart position for engaging the support section.

22. The furniture assembly of claim 21 together with a motor mounted on the framework, means for coupling the motor to the cross member to cause rotation of the cross member in one direction for raising the distal end portion of the respective support section and rotation of the cross member in an opposite direction for lowering the distal end portion of the support section.

23. The furniture assembly in claim 1 wherein the cushion has first and second opposite surfaces and is reversible so that one of the surfaces is facing upwardly.

24. The furniture assembly of claim 23 wherein the cushion can be used with other furniture pieces.

25. The furniture assembly of claim 1 wherein the seat and back sections can be lowered to a coplanar position for converting the furniture assembly to a bed.

26. The furniture assembly of claim 1 wherein the furniture assembly has a width sufficient to support two humans on the furniture assembly.

27. A furniture assembly as in claim 1 together with a table, means for mounting the table to the framework so that it is movable between a first position overlying the seat support section and a second out-of-the-way position not overlying the seat support section.

28. The furniture assembly of claim 27 wherein the means for mounting the table on the framework includes an arm pivotally coupled to the framework.

29. The furniture assembly of claim 28 wherein the framework has an arm socket joined thereon in an upright position, the arm socket provided with a bore which is circular in cross section, and wherein the arm has a first end portion which includes a substantially vertical tube, the tube disposed in the bore and thereby concentrically carried by the arm socket to permit pivoting of the arm with respect to the framework in a substantially horizontal plane.

30. The furniture assembly of claim 29 wherein the tube is provided with a plurality of transversely aligned adjustment bores and the arm socket has an upper surface, an adjustment member carried by an adjustment bore and protruding therefrom to bear on the upper surface and movable to another adjustment bore to raise or lower the height of the table with respect to the support surface.

31. The furniture assembly of claim 28 wherein the arm is formed from first and second sections, the first arm section pivotally coupled to the framework and the second arm section pivotally coupled to the first arm section, the first and second arm sections pivoting in substantially parallel horizontal planes.

32. The furniture assembly of claim 31 wherein the first arm section has a second end portion which includes a substantially vertical receptacle which is tubular in conformation and wherein the second arm section has a first end portion which includes a substantially vertical tube, the tube concentrically carried by the receptacle to permit pivoting of the second arm section with respect to the first arm section.

33. The furniture assembly of claim 28 wherein the means for mounting the table to the framework includes means for pivotally coupling the table to the arm.

34. The furniture assembly of claim 33 wherein the means for pivotally coupling the table to the arm includes clamping means to permit the table to pivot in substantially two orthogonal axes with respect to the arm.

35. The furniture assembly of claim 33 wherein the table and the arm pivot in substantially parallel planes.

36. The furniture assembly of claim 27 together with a serving tray mounted on the table for converting the furniture assembly into a dining arrangement, the serving tray removable from the table for use on an elevated surface.

37. The furniture assembly of claim 36 wherein the table is substantially rectangular in plan and has first and second opposite sides and wherein the serving tray is substantially rectangular in plan and has opposite side sections with substantially aligned portions thereon which cooperatively extend past the first and second opposite sides of the table to secure the tray thereon and serve as legs for supporting the serving tray on the elevated surface.

38. The furniture assembly of claim 36 wherein the serving tray includes a supplemental tray, means for removably mounting the supplemental tray in an elevated position above the serving tray.

39. The furniture assembly of claim 27 together with a worktable having a surface with a substantial area removably mounted on the table for converting the furniture assembly into a desk.

40. The furniture assembly of claim 39 wherein the worktable has central and arm portions and includes means for pivotally connecting the arm portion to the central portion.

41. The furniture assembly of claim 40 wherein the worktable includes a means for retaining the arm portion in a home position coplanar with the central portion.

42. The furniture assembly of claim 41 wherein the means for mounting the table to the framework includes an arm pivotally coupled to the framework and means for pivotally coupling the table to the arm, whereby pivoting of the table and worktable with respect to the arm causes the arm portion of the worktable to engage the arm and pivot with respect to the central portion of the worktable to a substantially horizontal position.

43. The furniture assembly of claim 27 wherein the table has a surface and includes a block movable from a first position where the block does not protrude from the surface and a second position where block does protrude from the surface for supporting objects on the table.

44. The furniture assembly of claim 43 wherein the table includes means for locking the block in the first position.

45. The furniture assembly of claim 27 together with a second table mounted to the framework, means for coupling the tables together.

46. The furniture assembly of claim 45 wherein the tables each have a surface which is substantially coplanar with the other when the tables are coupled together.

47. The furniture assembly of claim 27 for use by two humans with backs and seats, wherein the seat and back support sections are disposed on the framework to form seat and back supports respectively for the two humans.

48. The furniture assembly of claim 27 wherein the seat and back support sections can be lowered to a coplanar position for converting the furniture assembly to a bed.

49. A convertible furniture assembly for use on a horizontal support surface by a human, the convertible furniture assembly comprising a framework adapted to rest upon the support surface, upper and lower wing sections overlying the framework for supporting the upper and lower body portions of the human and having adjacent respective back and seat support sections for supporting the back and seat of the human an elongated cushion disposed simultaneously on both the wing sections and having a thickness, first hinge means supported by the framework forming a pivot axis interconnecting the back and seat support sections, said pivot axis extending transversely through the thickness of the cushion at all times and generally corresponding to the hip joints of the human, and first and second lifting and lowering means carried by the framework for respectively raising the back and seat support sections to a first position above the framework so that the upper and lower wing sections are suspended thereabove for use as part of a lounge and have the profile of the wings of a sea gull in flight, the upper wing section including a head support section for supporting the head of the human and second hinge means carried by the back support section forming a pivot axis interconnecting the back and head support sections and generally corresponding to the neck of the human, means carried by the back support section for adjusting the angular position of the head support section about the second hinge means and thereby determining the shape of the upper wing section, the lower wing section including a calf support section for supporting the claves of the human and third hinge means carried by the seat support section forming a pivot axis interconnecting the seat and calf support sections and generally corresponding to the knees of the human, means carried by the seat support section for adjusting the angular position of the calf support section about the third hinge means and thereby determining the shape of the lower wing section, the first and second lifting and lowering means permitting the upper and lower wing sections to be lowered to a second position on the framework so as to provide a generally horizontal surface on which the human can lie.

50. The convertible furniture assembly of claim 49 wherein the upper and lower wing sections are sized to support two humans with heads, backs, seat and calves.

51. The convertible furniture assembly of claim 50 wherein the calf support section is formed in two separate parts, one part for the claves of each human.

52. The convertible furniture assembly of claim 50 wherein the head section is formed in two separate parts, one part for the head of each human.

53. The convertible furniture assembly of claim 49 together with a pillow movably disposed on the head section and weight means connect to the pillow and extending and hanging over the head section so as to serve as a counterbalance to the pillow, the weight means frictionally engaging the head section so as to retain the pillow in a position to which it is moved.

54. The convertible furniture assembly of claim 49 together with a sheet covering the wing sections and a pillow disposed on the sheet, the sheet having a flap at one end which folds over the pillow.

55. The convertible furniture assembly of claim 54 together with weight means connected to the pillow which extends and hangs over the sheet so as to serve as a counterbalance to the pillow, the weight means frictionally engaging the sheet so as to retain the pillow in a position to which it is moved, the flap in the sheet being provided with a hole through which the weight means extends.

56. The convertible furniture assembly of claim 49 together with a slipcover adapted to enclose a bed covering, the slipcover having first and second sections for enclosing the bed covering therein, the second section being provided with an opening to permit the bed covering to be inserted and removed and having a strap thereacross for adding support to the slipcover.

57. The convertible furniture assembly of claim 56 wherein the opening in the slipcover is substantially in the center of the second section and is of significant size to permit viewing of the bed covering when inserted in the slipcover.

58. The convertible furniture assembly of claim 56 wherein the slipcover has a perimeter provided with a hole therein to permit access to the bed covering.

59. The convertible furniture assembly of claim 49 together with a table and means for mounting the table to the framework so that it is movable between a first position overlying the lower wing section and a second out-of-the-way position not overlying the lower wing section.

* * * * *